US008447219B2

(12) United States Patent
Furukata et al.

(10) Patent No.: US 8,447,219 B2
(45) Date of Patent: May 21, 2013

(54) FIXING DEVICE AND IMAGE FORMING APPARATUS

(75) Inventors: Hiroko Furukata, Saitama (JP); Kiichirou Arikawa, Kanagawa (JP); Shigeru Watanabe, Kanagawa (JP); Yasutaka Gotoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 288 days.

(21) Appl. No.: 12/904,439

(22) Filed: Oct. 14, 2010

(65) Prior Publication Data

US 2011/0211880 A1 Sep. 1, 2011

(30) Foreign Application Priority Data

Feb. 26, 2010 (JP) ..... 2010-041854

(51) Int. Cl.
*G03G 15/20* (2006.01)

(52) U.S. Cl.
USPC ..... 399/329; 399/67

(58) Field of Classification Search
USPC ..... 399/67, 328, 329
See application file for complete search history.

(56) References Cited

U.S. PATENT DOCUMENTS

| | | | | |
|---|---|---|---|---|
| 7,643,785 | B2 * | 1/2010 | Matsubara et al. | 399/329 |
| 7,664,415 | B2 * | 2/2010 | Mikutsu | 399/67 |
| 7,809,319 | B2 * | 10/2010 | Fujii | 399/329 |
| 2008/0205924 | A1 * | 8/2008 | Fujimoto | 399/70 |
| 2009/0226227 | A1 | 9/2009 | Furukata et al. | |

FOREIGN PATENT DOCUMENTS

JP 2009-216911 A 9/2009

* cited by examiner

*Primary Examiner* — Sandra Brase
(74) *Attorney, Agent, or Firm* — Sughrue Mion, PLLC

(57) ABSTRACT

A fixing device has a regulating mechanism for maintaining a contact portion of a pressing member in a state in which the contact portion does not contact with a fixing roll through a fixing belt from a second area to a first area or a state in which a pressure is reduced so that the contact portion contacts with the fixing roll when switching from a state in which the contact portion is placed in the second area to a state in which the contact portion is placed in the first area is carried out by a switching mechanism, and making a transition for the contact portion of the pressing member into a contact state at a predetermined pressure when the first area is reached.

5 Claims, 19 Drawing Sheets

JAM ELIMINATING MODE

MODE SWITCHING PROCESS

NORMAL MODE

FIXING DEVICE AND IMAGE FORMING APPARATUS

CROSS-REFERENCE TO RELATED APPLICATION

This application is based on and claims priority under 35 USC119 from Japanese Patent Application No. 2010-041854 filed on Feb. 26, 2010.

BACKGROUND

1. Technical Field

The present invention relates to a fixing device and an image forming apparatus.

2. Related Art

In an image forming apparatus such as a printer or a copying machine which forms an image constituted by a developer on a recording medium such as a paper, there is used a fixing device for fixing an unfixed image on the recording medium. For the fixing device, there is known a fixing device of such a type as to have a fixing roll to be rotated, a non-end shaped fixing belt which is rotated in contact with the fixing roll, and a pressing member forming a fixing portion (a pressure contact portion) which comes in contact with the fixing belt from a back face thereof to press a surface of the fixing belt against the fixing roll, thereby causing a fixing target to pass therethrough.

SUMMARY

[1] According to an aspect of the invention, a fixing device includes a fixing roll, a non-end fixing belt, a pressing member, a pressurizing mechanism, a changing mechanism, a switching mechanism and a regulating mechanism. The fixing roll is rotated. The non-end fixing belt is rotated in contact with the fixing roll. The pressing member contacts with a back side of the fixing belt and forms a fixing portion by pressing the fixing belt against the fixing roll from the back side of the fixing belt. A fixing target passes through the fixing portion. The pressurizing mechanism makes the pressing member to press against the fixing roll through the fixing belt. The changing mechanism displaces a contact portion of the pressing member against the fixing roll so that the contact portion is displaced from a first area including a first position to a second area including a second position The second position is on a downstream side in a passage direction of the fixing target in the fixing portion. The changing mechanism decreases or releases a predetermined pressure at the contact portion when the contact portion is at the second area. The pressure applied at the first area is the predetermined pressure. The switching mechanism switches into either a state in which the contact portion of the pressing member is placed in the first area or a state in which the contact portion is placed in the second area through the changing mechanism. The regulating mechanism, as the switching mechanism switches from the state in which the contact portion is placed in the second area to the state in which the contact portion is placed in the first area, (i) regulates the contact portion of the pressing member through the fixing belt in a state in which the fixing belt is detached from the fixing roll or a state in which the pressure is reduced so that the fixing belt is detach from or contacts with the fixing roll during the contact portion is moved from the second area to the first area, and (ii) transitions into a state in which the pressing member presses against the fixing roll through the fixing belt at the predetermined pressure at the first area.

BRIEF DESCRIPTION OF THE DRAWINGS

Exemplary embodiments of the invention will be described in detail based on the following figures, wherein.

DETAILED DESCRIPTION

An embodiment for carrying out the invention (hereinafter referred to as an "embodiment") will be described below with reference to the accompanying drawings.

Figure 1:
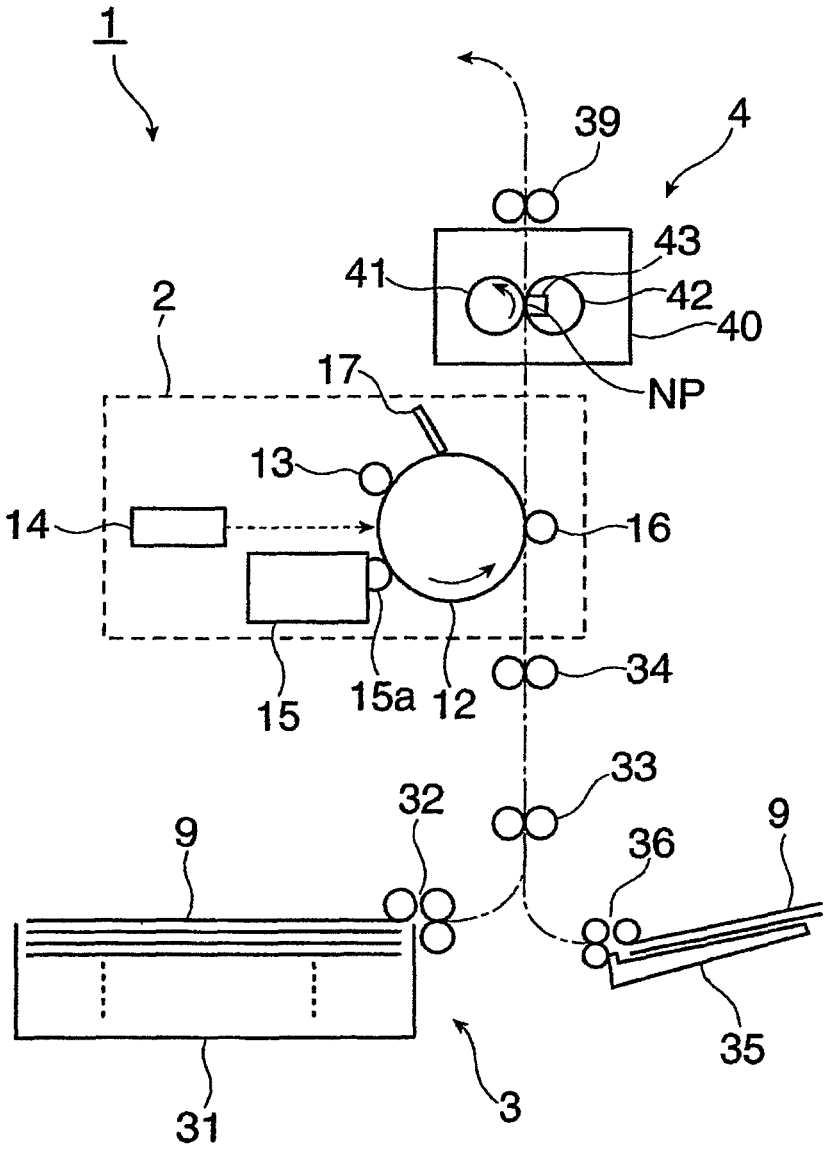
FIG. 1 is a schematically explanatory view showing an image forming apparatus including a fixing device according to a first embodiment.
Figure 2:
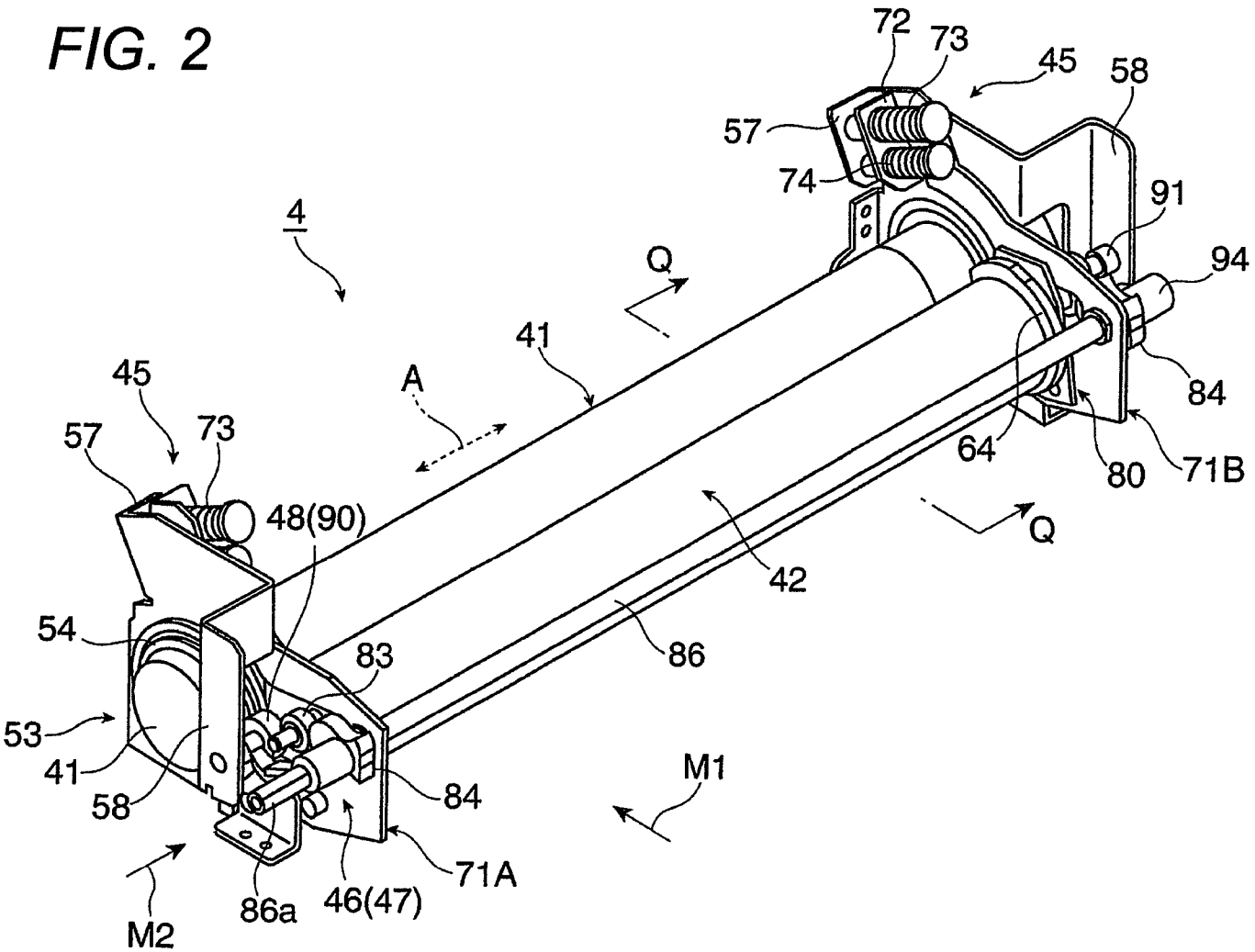
FIG. 2 is a perspective view showing a main part of the fixing device to be used in the image forming apparatus of FIG. 1.

FIG. 1 shows an image forming apparatus 1 (and a fixing device 4) according to a first embodiment of the invention.

The image forming apparatus 1 includes, in a housing which is not shown, an imaging device 2 for forming an unfixed toner image based on image information and finally transferring the toner image onto a recording medium 9 such as a paper, a paper feeding device 3 for accommodating the recording medium 9 and delivering and feeding the recording medium 9 to the imaging device 2, and the fixing device 4 for fixing the toner image transferred by the imaging device 2 to the recording medium 9. A one-dotted chain line having an arrow in the drawing indicates a main delivering path for the recording medium 9.

The imaging device 2 can form and transfer a toner image by utilizing a well-known electrophotographic method, for example. More specifically, the imaging device 2 includes a photosensitive drum 12 to be rotated in a direction of an arrow, and mainly has a charging device 13, an exposing device 14, a developing device 15, a transfer device 16 and a cleaning device 17 disposed around the photosensitive drum 12. The charging device 13 serves to charge a surface (an image holding surface) of the photosensitive drum 12. The exposing device 14 serves to irradiate a light based on image information (a signal) on the charged surface of the photosensitive drum 12, thereby forming an electrostatic latent image having a potential difference. The developing device 15 serves to develop the electrostatic latent image on the photosensitive drum 12 with a toner to be a developer, thereby forming a toner image. The transfer device 16 serves to transfer the toner image to the recording medium 9 fed from the paper feeding device 3. The cleaning device 17 serves to remove and clean away a toner remaining on the surface of the photosensitive drum 12 subjected to the transfer.

For example, as the photosensitive drum 12, an image holding surface having a photoconductive layer (a photosensitive layer) constituted by an organic photosensitive material is formed on a cylindrical substrate. The charging device 13 to be used is of a contact charging type for applying a predetermined charging voltage to a charging roll rotated in contact with the surface of the photosensitive drum 12 to carry out charging. The exposing device 14 to be used is constituted by an LED (light emitting diode) type recording head or a semiconductor laser scanning device. An image signal is input to the exposing device 14. The image signal is obtained after executing a predetermined processing, through an image processing device (not shown), over image information input from an image reading device or a storage medium reading device which is provided in or connected to the image forming apparatus 1 (is connected by cable or wireless) or an external apparatus serving as an image creating source, for example, a computer.

For the developing device 15 to be used, moreover, a developer containing a toner having a predetermined color (a single component developer or a two-component developer) is fed to the surface of the photosensitive drum 12 through a developing roll 15*a* to which a developing voltage is applied in a charging state. The transfer device 16 to be used is of a contact type for applying a predetermined transfer voltage to a transfer roll rotated in contact with the surface of the photosensitive drum 12, thereby carrying out a transferring operation.

The paper feeding device 3 mainly includes a housing cassette 31 for accommodating, in a stacking state, a plurality of recording media 9 having a predetermined size which is to be fed to the imaging device 2, and a sending device 32 for sending and delivering the recording media 9 accommodated in the housing cassette 31 one by one. A plurality of housing cassettes 31 is provided if necessary. Moreover, the paper feeding device 3 is connected to a paper delivering path for paper feeding which is constituted by a plurality of delivering roll pairs 33 and 34 for delivering the recording medium 9 from the housing cassette 31 to a transfer portion of the imaging device 2 (between the photosensitive drum 12 and the transfer device 16) and a delivery guiding member. The paper delivering roll pair 34 is constituted as a delivering time regulating roll pair for temporarily stopping a tip portion of the recording medium 9 to be delivered and then driving and sending the recording medium 9 when a predetermined paper feed timing arrives. The paper delivering path is also disposed between the imaging device 2 and the fixing device 4.

The fixing device 4 has a heating roll 41, a non-end shaped fixing belt 42 and a pressing member 43 disposed in a housing 40. The heating roll (a fixing roll) 41 is heated in such a manner that a surface temperature is held to be a predetermined temperature by heating means and is rotated in a direction of an arrow. The fixing belt 42 is rotated in contact with a surface portion almost in a rotating axis direction A of the heating roll 41. The pressing member 43 comes in contact with the fixing belt 42 from a back side to press a surface of the fixing belt 42 against the heating roll 41, thereby forming a pressure contact portion (a fixing portion) NP for causing a fixing target (the recording medium 9 to which a toner image is transferred) to pass therethrough. In FIG. 1, the reference numeral 39 denotes a discharging roll pair for discharging and delivering the recording medium 9 subjected to a fixation. The fixing device 4 will be described below in detail.

An image formation is carried out by the image forming apparatus 1 in the following manner.

First of all, in the imaging device 2, the photosensitive drum 12 is started to be rotated and the surface of the rotated photosensitive drum 12 is charged to have a predetermined charging potential by the charging device 13. Then, a light based on an image signal sent from the exposing device 14 is irradiated on the surface of the charged photosensitive drum 12 so that an electrostatic latent image having a predetermined latent image potential is formed. When the electrostatic latent image is moved with the rotation of the photosensitive drum 12 and thus passes through the developing device 15, subsequently, a toner supplied from the developing roll 15*a* of the developing device 15 electrostatically sticks to a latent image portion so that the electrostatic latent image is developed as a toner image. Thereafter, the toner image on the photosensitive drum 12 is electrostatically transferred onto the recording medium 9 sent and delivered from the paper feeding device 3 in a transfer position opposed to the transfer device 16. The surface of the photosensitive drum 12 subjected to the transfer of the toner image is cleaned by the cleaning device 17.

Next, the recording medium 9 having the unfixed toner image formed in the imaging device 2 is delivered to the fixing device 4 and is introduced into the pressure contact portion NP between the heating roll 41 and the fixing belt 42. In the fixing device 4, consequently, the recording medium 9 is delivered and passes in a state in which it is interposed in the pressure contact portion NP, and the unfixed toner image is heated under pressure and is thus fixed to the recording medium 9 in that case. The recording medium 9 subjected to the fixation is discharged from the fixing device 4 and is then delivered by means of the discharging roll pair 39, and is thus sent to a discharging housing portion which is not shown. Consequently, an image constituted by a toner is formed on a single side of the recording medium 9.

In the image forming apparatus 1, it is possible to use an envelope-shaped object taking a configuration of a bag which is represented by an envelope in addition to a sheet-shaped object, for example, a recording paper, a thick paper, a transparent sheet or a postcard as the recording medium 9 to be an image forming target. The recording medium 9 to be the envelope-shaped object is accommodated in the housing cassette 31 of the paper feeding device 3 and is delivered to the transfer position of the imaging device 2 via the paper delivering path for paper feeding in an image formation or is accommodated in a manual housing base 35, and is caused to meet the paper delivering path for paper feeding by a sending device 36 and is thus delivered to the transfer position of the imaging device 2 in the image formation as shown in FIG. 1.

Next, the fixing device 4 will be described in detail.

Figure 3:
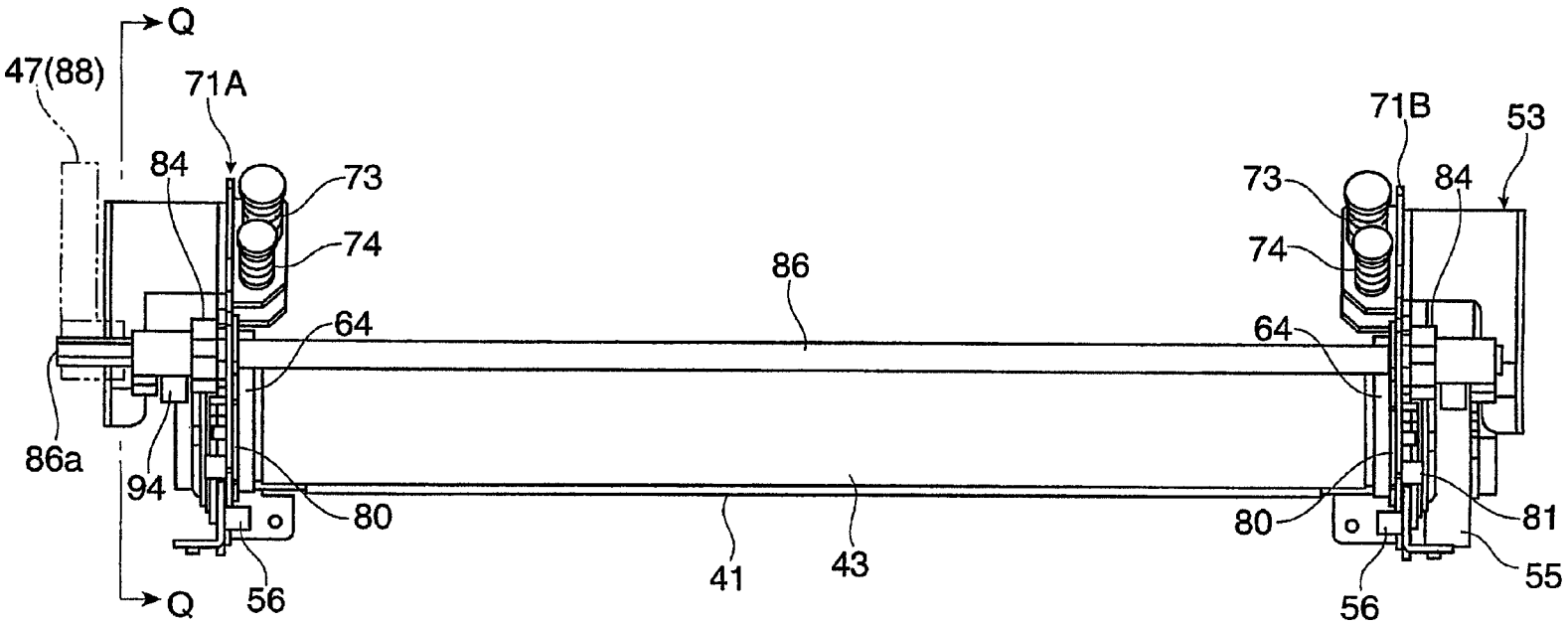
FIG. 3 is a view showing the fixing device of FIG. 2 as seen in a direction of an arrow M1.
Figure 4:
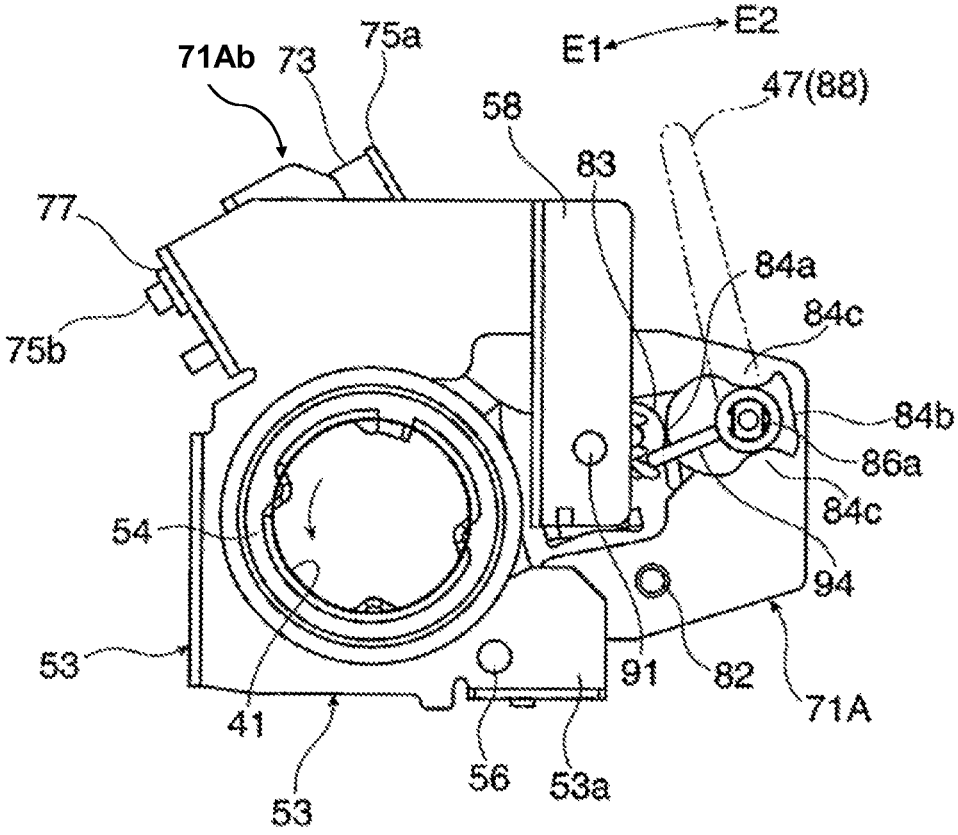
FIG. 4 is a view showing the fixing device of FIG. 2 as seen in a direction of an arrow M2.

As shown in FIGS. 2 to 7, the fixing device 4 includes a pressurizing mechanism 45 for applying a pressure for pressing the pressing member 43 against the heating roll 41 (through the fixing belt 42) to the pressing member 43, a changing mechanism 46 for changing a state of the pressing member 43, and a switching mechanism 47 for switching a state obtained by the changing mechanism 46 in addition to the heating roll 41, the fixing belt 42 and the pressing member 43. In FIGS. 3 and 4, the reference numeral 88 shown in a two-dotted chain line denotes an operating lever constituting the switching mechanism 47.

The heating roll 41 is obtained by forming a cylindrical base material formed of a metal and having a greater length than a maximum delivering width of the recording medium 9 to be a fixing target, and an elastic layer and a mold releasing layer on a surface of the cylindrical base material in this order. A heating device (not shown) for heating the heating roll 41 to have a predetermined temperature is disposed in a cylinder of the heating roll 41. The heating roll 41 is rotatably supported on a fixing frame 53 at both ends thereof.

The heating roll 41 has the both ends attached to the fixing frame 53 through a bearing 54, and a rotating power is transmitted from a rotating and driving device disposed on an image forming apparatus 1 body side to a gear 55 attached to one of the ends of the heating roll 41 so that a rotating and driving operation is carried out at a predetermined speed. Moreover, a temperature of the surface of the heating roll 41 is detected by a temperature detector which is not shown and a heating operation of the heating device is controlled based on information about the detection so that the heating roll 41 is held to have a predetermined temperature.

The fixing frame 53 has a first shaft 56 provided on an internal surface side of a portion 53*a* to be an introducing side of the recording medium 9 with the pressure contact portion NP interposed between the heating roll 41 and the fixing belt 42, and furthermore, a spring support surface portion 57 to be used in combination with the pressurizing mechanism 45 is formed in a portion 53*b* to be a discharging side of the recording medium 9 with the pressure contact portion NP interposed therebetween. The spring support surface portion 57 is formed with bending toward an inside of the fixing frame 53. The fixing frame 53 is attached to the housing 40 of the fixing device 4 in a fixing state.

The fixing belt 42 is a cylindrical belt having an almost equal width to a length of the heating roll 41 (a dimension in an axial direction). The fixing belt 42 to be used is obtained by providing a mold releasing layer constituted by a fluorine based resin on a surface of a belt base material formed thinly and cylindrically by a synthetic resin such as polyimide.

Figure 5:
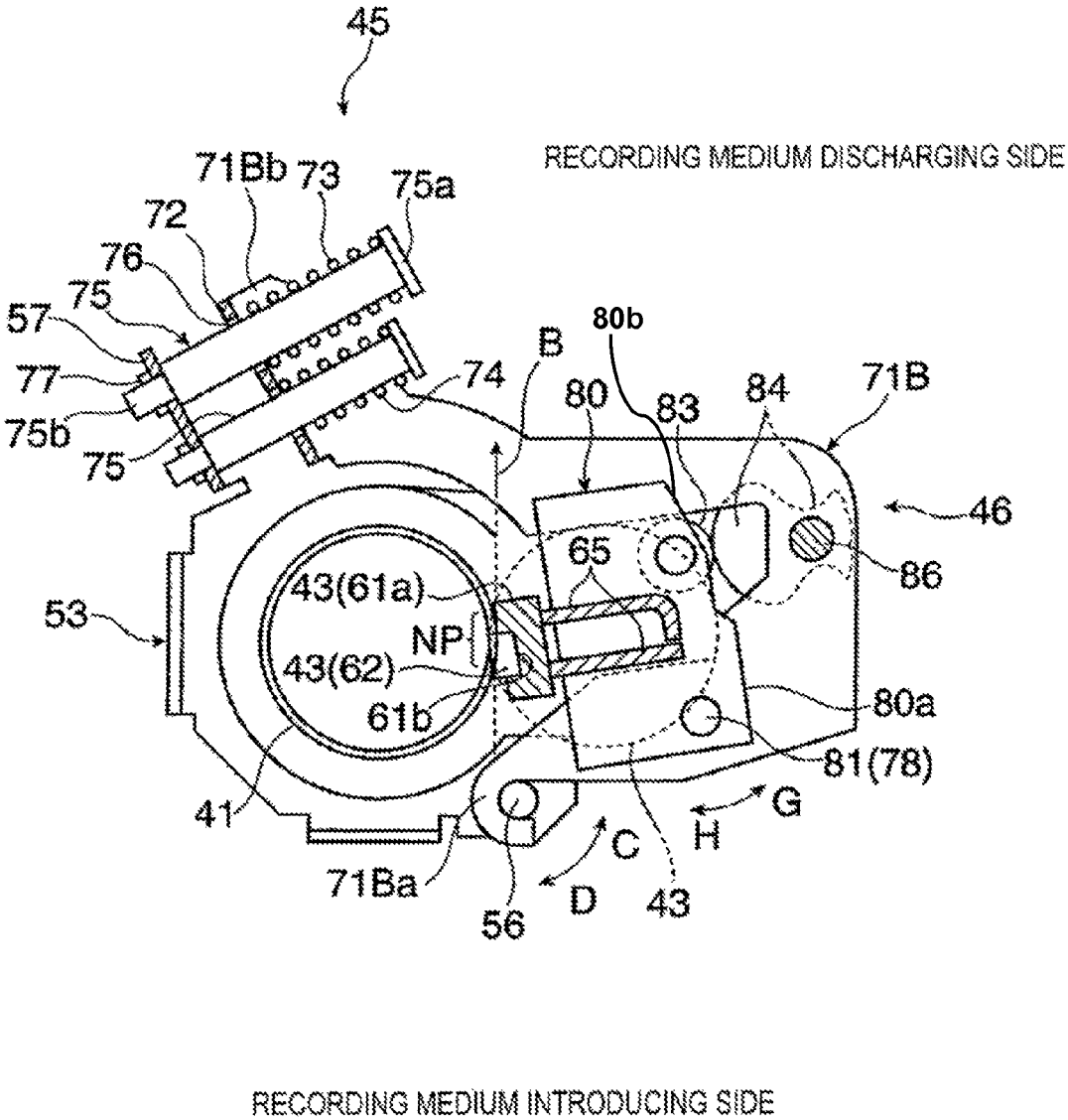
FIG. 5 is a partially sectional view taken along a Q-Q line in the fixing device of FIG. 2.

As shown in FIG. 5, the pressing member 43 is constituted by a head member 61 and a pad member 62 which have almost equal lengths to the width of the fixing belt 42 and take slender shapes. The head member 61 is formed by a non-elastic member constituted by a synthetic resin or a metal. The head member 61 according to the first embodiment takes such a shape as to have a protruded portion 61*a* positioned on the recording medium discharging side of the pressure contact portion NP and serving to cause the fixing belt 42 to come in contact with the surface of the heating roll 41 and a pad holding portion 61*b* positioned on the recording medium introducing side of the pressure contact portion NP and serving to hold the pad member 62. The pad member 62 is formed by an elastic member constituted by a rubber material. The pad member 62 according to the first embodiment is formed to take a configuration of a slender plate (a sectional shape in a non-load state: a rectangle) by using a silicone rubber.

Figure 6:
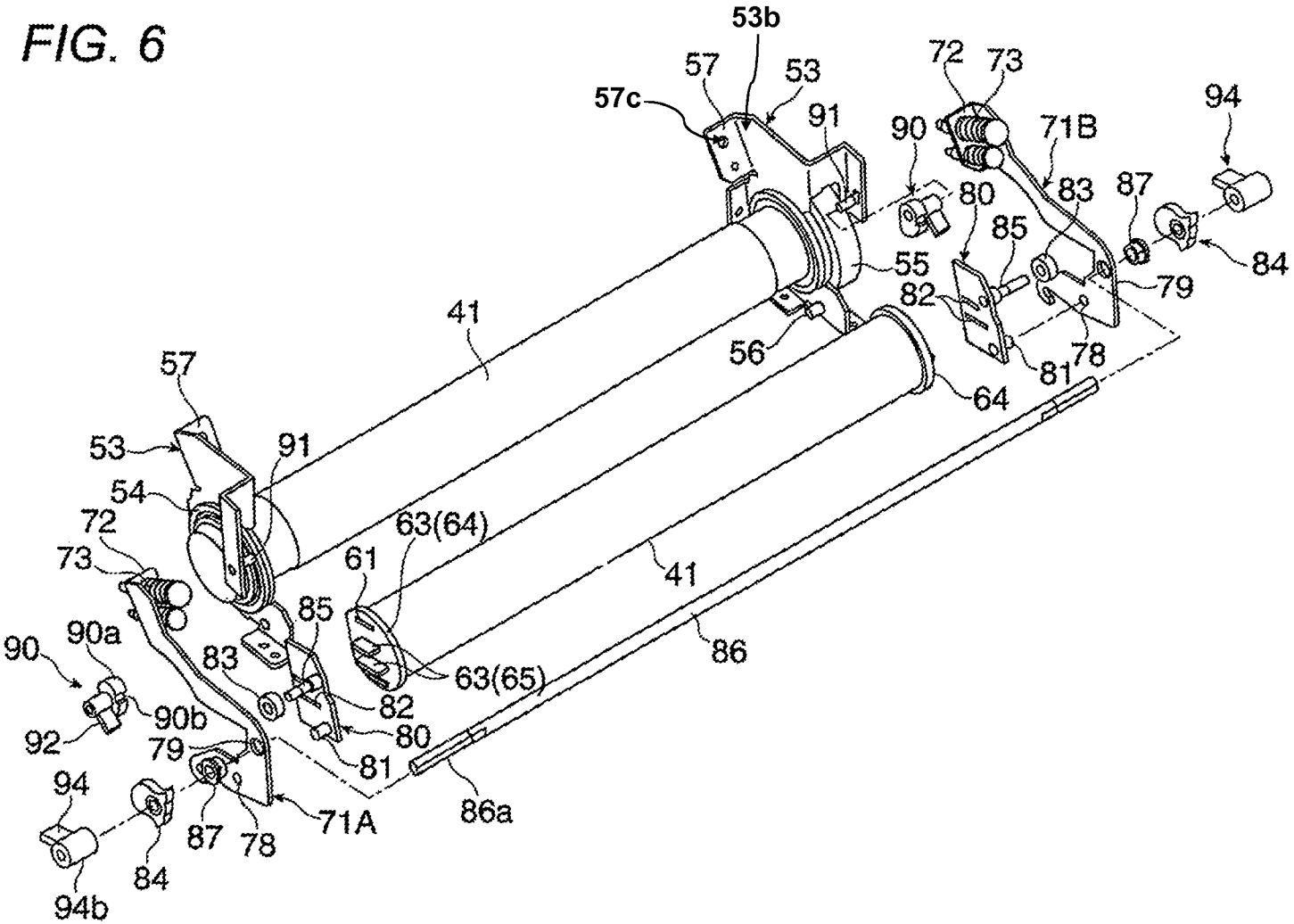
FIG. 6 is an exploded perspective view showing the fixing device of FIG. 2.
Figure 7:
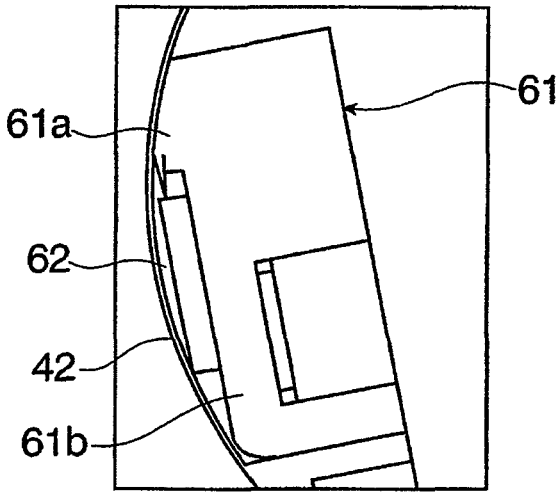
FIG. 7 is an enlarged explanatory view showing a structure of a contact portion of a pressing member in the fixing device of FIG. 2 (a state of non-pressurization)
Figure 8:
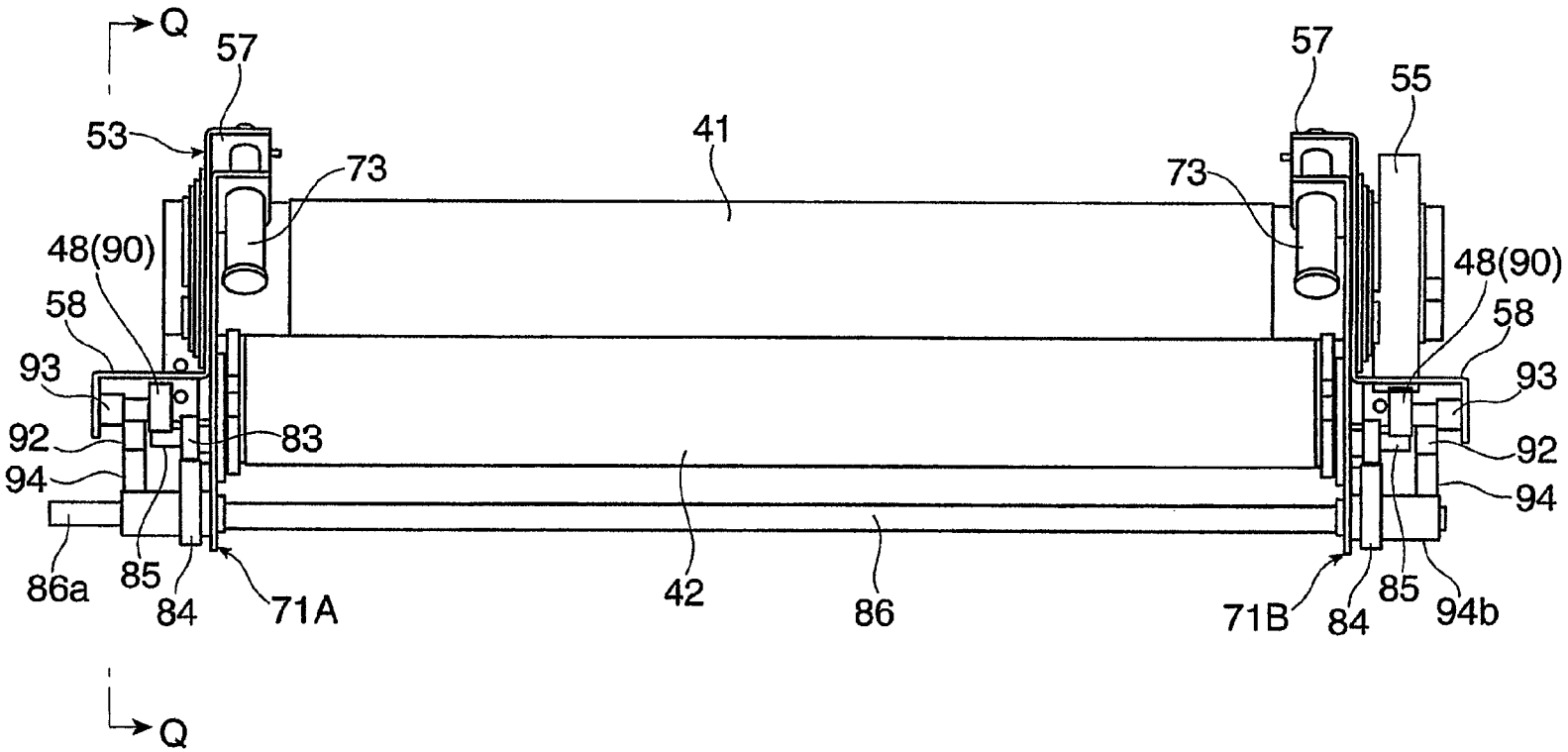
FIG. 8 is a plan view showing the fixing device of FIG. 2.
Figure 9:
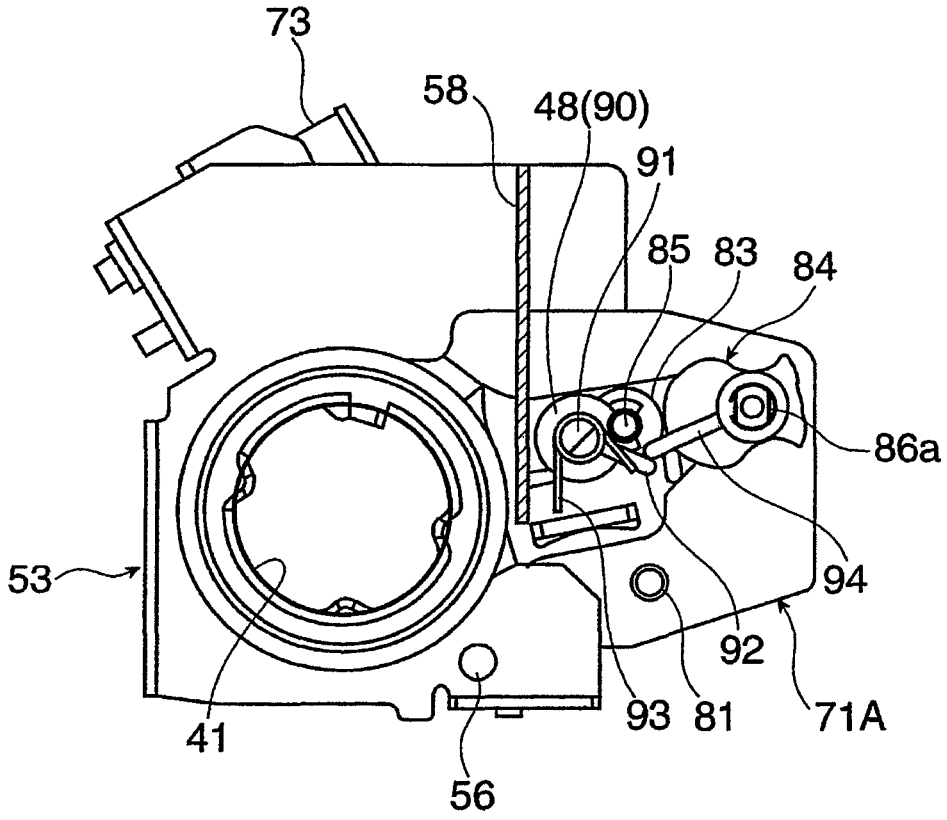
FIG. 9 is a partially sectional view taken along a Q-Q line in the fixing device of FIG. 8.

The fixing belt 42 and the pressing member 43 are supported by a press supporting member 63. As shown in FIG. 6, the press supporting member 63 is mainly constituted by a side surface guide plate 64 for guiding and supporting both ends of the fixing belt 42 and a part of an inner peripheral surface thereof to enable a rotation, and a support plate 65 for supporting (the head member 61 of) the pressing member 43 in contact with a back face thereof. Two support plates 65 are used, and both ends of each of the support plates 65 are held in a fitting state in attaching holes (82) formed on a rock holding plate (80) which will be described below.

The pressurizing mechanism 45 is mainly constituted by a pair of pressurization rocking frames 71A and 71B which are rockably attached to a part of the fixing frame 53, and two compression coil springs 73 and 74 which are distributed and disposed in the pressurization rocking frames 71A and 71B and serve to apply a pressure for rocking the rocking frame (a movable member) 71 in such a direction as to approach the heating roll 41.

The pair of pressurization rocking frames 71A and 71B are formed in a once curved shape in order to make a detour in such a direction as to separate from the heating roll 41 side between the portion 53*a* to be the recording medium introducing side of the fixing frame 53 to the portion 53*b* to be the recording medium discharging side thereof.

In the pressurization rocking frames 71A and 71B, rocking fulcrum side ends 71Aa and 71Ba to be the recording medium introducing side with the pressure contact portion NP interposed therebetween are formed to take a shape of a hook having a bent tip. The pressurization rocking frames 71A and 71B are rocked in directions of arrows C and D in order to bring a state in which the ends 71Aa and 71Ba are attached to the first shaft 56 of the fixing frame 53 and approach and separate from the heating roll 41 in this condition. Moreover, the pressurization rocking frames 71A and 71B have a spring pressing surface portion 72 formed on ends 71Ab and 71Bb to be the recording medium discharging side thereof. One of ends in each of the two compression springs 73 and 74 comes in contact with the spring pressing surface portion 72, thereby applying spring forces thereof. The spring pressing surface portion 72 is bent inward, and furthermore, is formed opposite to the spring supporting surface portion 57 of the fixing frame 53.

The compression coil springs 73 and 74 are constituted by a first compression coil spring 73 having a great spring constant and a second compression coil spring 74 having a smaller spring constant than that of the first compression coil spring 73. In the first embodiment, the compression coil springs 73 and 74 to be used have free lengths which are equal to each other. It is possible to properly set the free lengths of the compression springs 73 and 74 and a condition such as the spring constant.

Moreover, the compression coil springs 73 and 74 are disposed in such a state that the spring pressing surface portion 72 of the pressurization rocking frame 71 can be pressed to be rocked in the direction C to approach the heating roll 41. Furthermore, the compression coil springs 73 and 74 are distributed and disposed in positions in which clearances M from the first shaft 56 in the fixing frame 53 are different from each other. In the first embodiment, the first compression coil spring 73 is disposed in a position in which a distance M1 from the first shaft 56 is great, and the second compression coil spring 74 is disposed in a position in which a distance M2 (<M1) from the first shaft 56 is small.

In addition, the compression coil springs 73 and 74 are attached by a strut 75 having such a length (a greater dimension than the free length of the coil spring) as to be inserted into a coil winding space from one of ends thereof and to be protruded from the other end thereof as shown in FIG. 5. The strut 75 is provided with a flange portion 75*a* having a larger diameter than an outside diameter of the coil spring in an upper part of a strut body and a screw portion 75*b* having a smaller diameter than that of the strut body in the lower part of the strut body. In the first embodiment, the length of (the body portion of) the strut 75 for the first compression coil spring 73 which is to be used has a greater length than that of the strut 75 for the second compression coil spring 74. In FIGS. 5 and 6, the reference numeral 76 denotes a strut through hole formed on the spring pressing surface portion 72 of the pressurization rocking frame 71 (a hole having a smaller diameter than the outside diameter of the coil spring) and the reference numeral 77 denotes a nut for fixing a screw portion 75*b* of the strut 75 which is fitted in a strut attaching hole 57*c* formed on the spring support surface portion 57 in the fixing frame 53.

The pressurizing mechanism 45 holds the compression coil springs 73 and 74 in an interposing state between the protruded portion 75*a* of the strut 75 which is fixed to the spring support surface portion 57 of the fixing frame 53 and the spring pressing surface portion 72 of the pressurization rocking frame 71 and maintains them in a compressing state in a predetermined compression amount. At this time, a compression amount (P) of the compression coil spring is almost equal to a value obtained by subtracting a distance E between the spring pressing surface portion 72 and the strut flange portion 75*a* from a free length (L) of the compression coil spring (P=L−E). Since the strut 75 is fixed to the spring pressing surface portion 72, the strut flange portion 75*a* is maintained into a certain position.

In the pressurizing mechanism 45, the compression coil springs 73 and 74 press the spring pressing surface portion 72 of the pressurization rocking frames 71A and 71B in such a direction as to approach the spring supporting surface portion 57 of the fixing frame 53 by spring forces F1 and F2 of the compression coil springs 73 and 74 which are applied corresponding to the compression amounts and the spring constants at that time. Consequently, the pressurization rocking frames 71A and 71B are wholly rocked in such a direction as to approach the heating roll 41 (rocked in the direction of the arrow C). Thus, there is employed an arrangement for finally transmitting and applying, to the pressing member 43, a pressure (a pressing force) generated by rocking the pressurization rocking frames 71A and 71B in the direction of the arrow C through a corresponding portion to a structure part of the changing mechanism 46 which will be described below.

The changing mechanism 46 serves as a structure portion having a function for displacing a portion of the pressing member 43 to come in contact with the heating roll 41 through at least the fixing belt 42 at a predetermined pressure (the protruded portion 61*a* of the head portion 61 and the pad portion 62) between a normal set position (a first position) and a set position in changing (a second position) which is set into a position at a downstream side in a direction B of a passage of the recording medium 9 holding an unfixed toner image to be a fixing target in the pressure contact portion NP from the normal set position. Moreover, the changing mechanism 46 also serves as a structure portion having a function for causing the pressing member 43 to decrease or cancel (invalidate) a predetermined pressure applied from the pressurizing mechanism 45 when the contact portion of the pressing member 43 is displaced from the normal set position to the set position in changing.

The changing mechanism 46 according to the first embodiment has such a structure as to serve as a part of the pressurizing mechanism 45 (a structure portion for transmitting a pressure to the pressing member 43) as described above. In the changing mechanism 46, first of all, the pressing member 43 is held in the rock holding plate (a holding member) 80 which is rockably attached to a part of the pressurization rocking frame 71 in the pressurizing mechanism 45.

As shown in FIGS. 5 and 6, the rock holding plate 80 is an almost rectangular plate member disposed in a state in which it is adjacent to both ends in a longitudinal direction of the pressing member 43. In the rock holding plate 80, a second shaft 81 provided on an end 80*a* to be an upstream side in the direction B of a passage of a fixing target is rotatably fitted in the bearing hole 78 formed in a close part to an end 71*b* in which the first shaft 56 is present from a central part of the pressurization rocking frame 71. Consequently, the rock holding plate 80 is attached to the rocking frame 71 in a rockable state. Moreover, an end of the support plate 65 of the pressing member 43 is fitted in the attaching hole 82 formed in a central part of the rock holding plate 80. Consequently, the rock holding plate 80 holds the pressing member 43. Accordingly, the rock holding plate 80 is brought into a rocking state in directions of arrows G and H by setting the shaft 81 as a fulcrum so that at least the contact portion (the head member 61 and the pad member 62) in the pressing member 43 held by the rock holding plate 80 can be displaced into the downstream and upstream sides in the direction B of the passage of the fixing target in the pressure contact portion NP.

In the changing mechanism 46, referring to the normal set position, there is set a position in which both the head member 61 and the pad member 62 in the pressing member 43 held in the rock holding plate 80 come in contact with the heating roll 41 through the fixing belt 42. Moreover, the following two positions are set to the changing set position. One of them is set to a position (a first set position in changing) in which the rock holding plate 80 is rocked in the direction of the arrow H to displace the pressing member 43 to the downstream side in the direction B of the passage of the fixing target so that only the pad member 62 of the pressing member 43 comes in contact with the heating roll 41 through the fixing belt 42. The other is set to a position (a second set position in changing which corresponds to the "second position") in which the rock holding plate 80 is further rocked in the direction of the arrow H to further displace the pressing member 43 to the downstream side in the direction B of the passage of the fixing target so that neither of the head member 61 and the pad member 62 in the pressing member 43 come in contact with the heating roll 41 through the fixing belt 42 (a second set position in changing which corresponds to the "second position").

In the changing mechanism 46, moreover, a cam receiving member 83 for receiving an action of a cam through a contact of the cam is provided on an end 80*b* to be the downstream side in the direction B of the passage of the fixing target in the rock holding plate 80 in order to rock the rock holding plate 80 in the directions of the arrows G and H by setting the second shaft 81 as a fulcrum, and a changing cam 84 to come in contact with the cam receiving member 83 is provided in an almost central part of the pressurization rocking frame 71 of the pressurizing mechanism 45. The changing cam 84 also has a function for changing a condition of a pressure applied from the pressurizing mechanism 45 and transmitting the pressure to the rock holding plate 80 in addition to the function of the changing mechanism 46.

The cam receiving member 83 is obtained by providing a shaft 85 in an outward protruding state in a position shifted toward the downstream side in the direction B of the passage of the fixing target from the pressure contact portion NP at the end 80*b* of the rock holding plate 80 and rotatably attaching a disc-shaped rotor to the shaft 85. The cam receiving member (rotor) 83 is disposed in such a condition that it can pass through a bent part of the pressurization rocking frame 71 to enable a contact with the changing cam 84 in an outside position of the frame 71.

The changing cam 84 is rotatably attached to a part of the pressurization rocking frame 71, and furthermore, is disposed in contact with the cam receiving member 83 of the rock holding plate 80. The changing cam 84 according to the first embodiment is attached, in a fixing state in outside positions of the rocking frames 71A and 71B, to a connecting shaft 86 which is rotatably attached to slightly shifted parts toward the downstream side in the direction B of the passage of the fixing target from the pressure contact portion NP in the bent parts of the pressurization rocking frames 71A and 71B. The connecting shaft 86 is rotatably attached through a bearing 87 to the shaft attaching hole 79 provided in the part of the pressurization rocking frame 71.

Moreover, the changing cam 84 has three cam surfaces for regulating a distance K from a contact point in contact with the cam receiving member 83 in the rock holding member 80 (a clearance from the cam connecting shaft 86), that is, a first cam surface 84*a*, a second cam surface 84*b* and a third cam surface 84*c* (FIG. 4). The changing cam 84 is brought into a state in which one of the three cam surfaces comes in contact with the cam receiving member 83.

The first cam surface 84*a* is formed to be present in the most distant position from the connecting shaft 86 (K1: cam radius) in the three cam surfaces and is used as a cam surface in the case in which the contact portion of the pressing member 43 is disposed in the normal set position. The first cam surface 84*a* is formed as an outer peripheral surface of a large diameter portion having a portion in which the cam radius has a maximum value. The second cam surface 84*b* is formed to be present in a closer position (K2<K1) to the cam connecting shaft 86 than the first cam surface 84*a* and is used as a cam surface in the case in which the contact portion of the pressing member 43 is pressed against the first set position in changing and the pressing member 43 is thus disposed. The second cam surface 84*b* is formed as an outer peripheral surface of a middle diameter portion including a portion in which the cam radius has an intermediate value. The third cam surface 84*c* is formed to be present in a closer position (K3<K2) to the cam connecting shaft 86 than the second cam surface 84*b* and is used as a cam surface in the case in which the contact portion of the pressing member 43 is disposed in the second set position in changing. The third cam surface 84*c* is formed as an outer peripheral surface of a small diameter portion including a portion in which the cam radius has a minimum value, for example.

The switching mechanism 47 has a function for enabling switching into any of a normal state in which the contact portion of the pressing member 43 with the heating roll 41 (through the fixing belt 42) is placed in the normal set position (a state in which the contact portion is placed in the first position), a first state in changing in which the contact portion is placed in the first set position in changing, and a second state in changing in which the contact portion is placed in the second set position in changing (a state in which the contact portion is placed in the second position) by the changing mechanism 46.

The switching mechanism 47 according to the first embodiment is constituted by the connecting shaft 86 for fixing two changing cams 84 and the operating lever (a member which rotates changing cams) 88 fixed and attached to an end 86*a* of the connecting shaft 86. The operating lever 88 can be rocked to be tilted by a predetermined angle around the end 86*a* of the connecting shaft 86 as shown in FIG. 4, and has a function for switching the changing cam 84 fixed to the connecting shaft 86 into a state in which any of the three cam surfaces 84*a* to 84*c* comes in contact with the cam receiving member 83 by the rocking operation.

In the fixing device 4, the normal state is applied in the case in which a paper to be a sheet-shaped object (other than an envelope-shaped object) is used as the recording medium 9 to form an image (including a fixing step) (corresponding to a time that a "normal mode" to be described below is selected. See FIGS. 10 and 11). Moreover, the first state in changing is applied in the case in which the envelope-shaped object is used as the recording medium 9 to form an image (corresponding to a time that an "envelope mode" to be described below is selected. See FIG. 13A). Furthermore, the second state in changing is applied in the case in which a work for taking the recording medium 9 getting jammed away from the fixing device 4 is carried out in an occurrence of a phenomenon (a jam phenomenon) in which the recording medium 9 gets jammed in an interposing state in the pressure contact portion NP of the fixing device 4 (corresponding to a time that a "jam eliminating mode" to be described below is selected. See FIGS. 13B and 14).

Moreover, the fixing device 4 is provided with a regulating mechanism 48 for maintaining the contact portion (the head member 61 and the pad member 62) of the pressing member 43 so as not to come in contact with the heating roll 41 through the fixing belt 42 from the second set position in changing to the normal set position when switching from the second state in changing (the jam eliminating mode) to the normal state (the normal mode) is carried out by the switching mechanism 47, and making a transition to the normal state when the normal set position is reached as shown in FIGS. 8 to 11.

The regulating mechanism 48 has a regulating cam (a regulating member) 90 serving as a regulating member for coming in contact with the shaft 85 of the cam receiving member 83 to be displaced upon receipt of a force of the changing cam 84 of the changing mechanism 46, thereby inhibiting the displacement of the cam receiving member 83 in a process in which the changing cam 84 is rotated in a direction E1 of a transition from the third cam surface 84*c* in the small diameter portion to the first cam surface 84*a* in the large diameter portion, and cancelling a state in which a displacement of the shaft 85 of the cam receiving member 83 is inhibited when the contact portion of the pressing member 43 reaches the normal set position.

The regulating cam 90 takes such a shape as to include a cam acting portion 90*a* which applies an action of the cam to the shaft 85 of the cam receiving member 83 and a cam non-acting portion 90*b* which does not apply the action of the cam. The cam acting portion 90*a* serves to apply an action for inhibiting the displacement from being caused by the action of the cam received from the changing cam 84 in contact of the shaft 85 of the cam receiving member 83, and is formed to take a shape of a disc having a predetermined diameter, for example. The cam non-acting portion 90*b* serves to cancel the action for inhibiting the displacement of the shaft 85 of the cam receiving member 83 through the cam acting portion 90*a* and is formed to take a curved cut concave shape in such a manner that a part of an outer peripheral portion of the cam acting portion 90*a* does not come in contact with the shaft 85 of the cam receiving member 83, for example.

A cam radius of the cam acting portion 90*a* is set corresponding to contents of a request for a state of the contact portion of the pressing member 43 with respect to the heating roll 41 (a structure for bringing a "non-contact state" in the embodiment) in a process for switching the contact portion of the pressing member 43 from the second state in changing to the normal state. On the other hand, the cam non-acting portion 90*b* is set to take such a shape that it can be maintained in non-contact with the shaft 85 of the cam receiving member 83 when the contact portion of the pressing member 43 reaches the normal set position.

In the first embodiment, the cam radius of the cam acting portion 90*a* is set to have such a value as to maintain a state in which the cam acting portion 90*a* does not come in contact with the shaft 85 of the cam receiving member 83 but a predetermined clearance S is formed when the contact portion of the pressing member 43 is present in the second set position in changing (the second state in changing in a selection of the jam eliminating mode), and to maintain a state in which the shaft 85 of the cam receiving member 83 that is being displaced through pressing by the action of the changing cam 84 comes in contact with the cam acting portion 90*a* and the shaft 85 is not displaced but its position is fixed even if it is pressed by the changing cam 84 after the contact in a process in which the contact portion of the pressing member 43 has not reached the normal set position. At this time, in the position to be fixed after the cam acting portion 90*a* comes in contact with the shaft 85 of the cam receiving member 83, it is possible to maintain a state in which the contact portion of the pressing member 43 does not come in contact with the heating roll 41 (through the fixing belt 42).

The regulating cam 90 is rotatably attached to a fixing shaft 91 provided on a cam attaching surface portion 58 of the fixing frame 53. The cam attaching surface portion 58 is formed as a surface which is present in an opposing state at an interval in a portion on the cam receiving member 83 side from the changing cam 84 in a part of the fixing cam 53.

Figure 10:
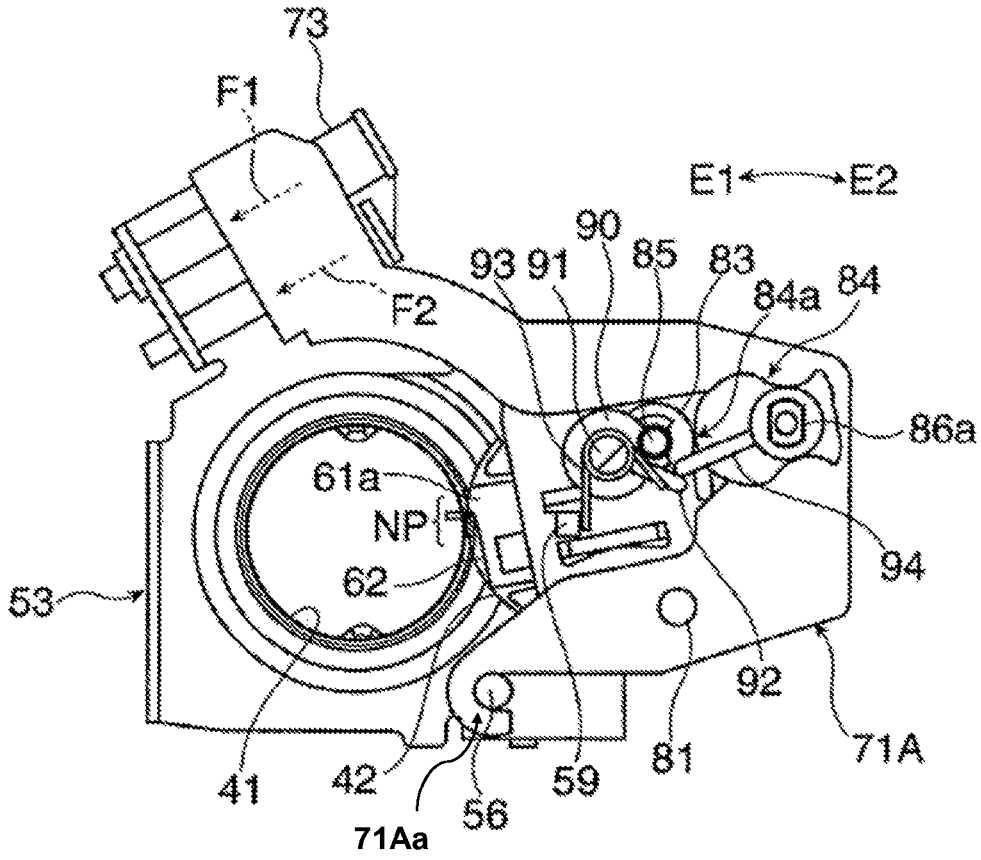
FIG. 10 is an explanatory view showing a state in which a part of a fixing frame in the fixing device of FIG. 9 is taken away.
Figure 11:
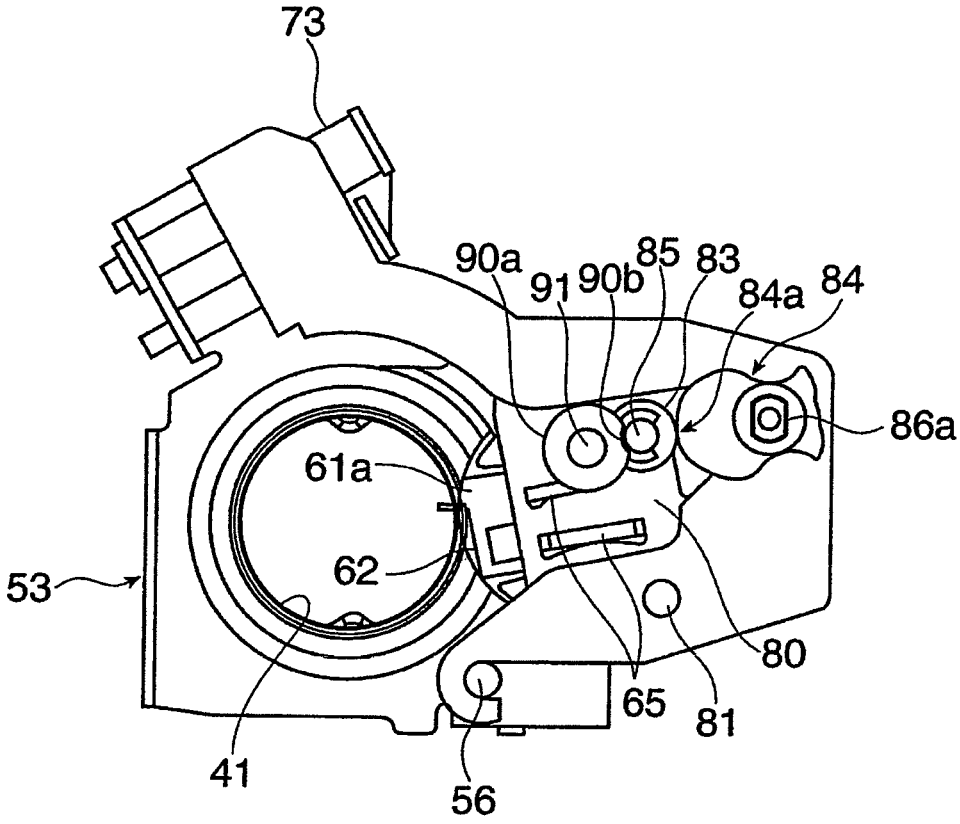
FIG. 11 is an explanatory view showing a state in which a part of a regulating mechanism in the fixing device of FIG. 10 (a protruded plate, a movable protruded plate and a coil spring) is taken away.
Figure 12A:
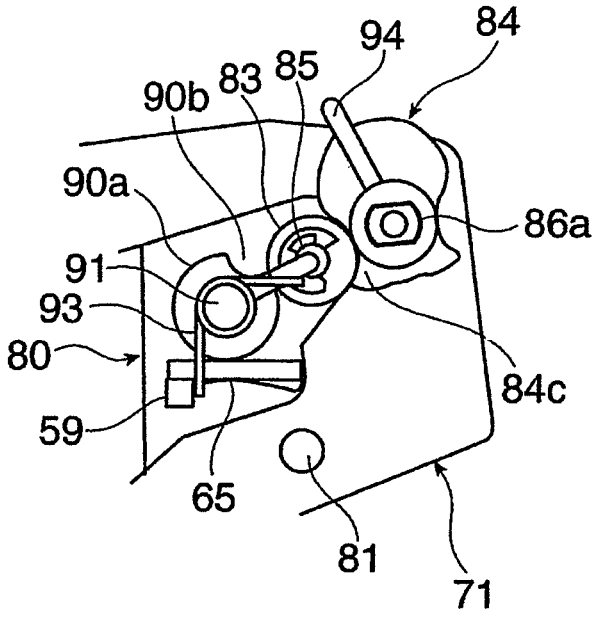
FIGS. 12A and 12B are enlarged views showing a main part, illustrating a structure of the regulating mechanism in the fixing device.
Figure 12B:
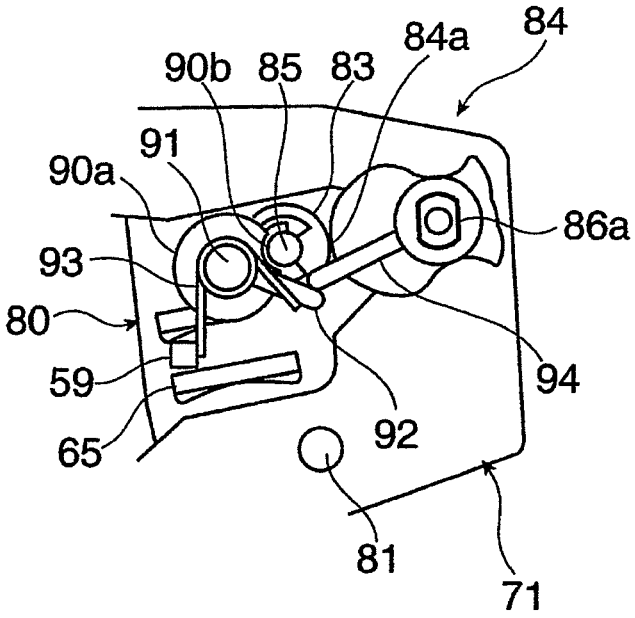

Moreover, the regulating cam 90 has a protruded plate (a protruded portion) 92 to be moved interlockingly with a rotation of the cam 90 as shown in FIGS. 10, 12A and 12B.

The protruded plate 92 is formed to take a shape of a plate which has a bottom part attached rotatably to the fixing shaft 91 and a tip part protruded almost in a diametral direction of the fixing shaft 91. Moreover, the protruded plate 92 is connected to be rotated around the fixing shaft 91 interlockingly with the rotation of the regulating cam 90 and is disposed in a predetermined positional relationship with the cam non-acting portion 90*b* of the regulating cam 90 in such a manner that the cam non-acting portion 90*b* can be rotated and moved to an opposed position to the shaft 85 of the cam receiving member 83 by an action of a movable protruded plate (94) which will be described below. The protruded plate 92 may be formed in an integral configuration with the regulating cam 90.

Furthermore, the protruded plate 92 has a coil spring 93 attached thereto. The coil spring 93 serves to apply a force for rotating the regulating cam 90 in a direction E1 in which the cam non-acting portion 90*b* of the regulating cam 90 is moved to a non-opposed position to the shaft 85 of the cam receiving member 83 when an action of a movable protruded plate (94) to be described below is not received. In the first embodiment, a helical spring is used as the coil spring 93 as shown in FIGS. 12A and 12B. In the helical spring, a coil portion (a winding body portion) is fitted in the fixing shaft 91, and one of ends is hung on a part of the protruded plate 92 and the other end is attached to a spring stopping portion 59 provided on a part of the cam attaching surface portion 58.

Moreover, the regulating mechanism 48 has the movable protruded plate (a protruded member) 94 which is moved interlockingly with the rotation of the changing cam 84 in the changing mechanism 46 and can come in contact with the protruded plate 92 as shown in FIGS. 10, 12A and 12B. The movable protruded plate 94 comes in contact with the protruded plate 92 provided together with the regulating cam 90 and is movable to rotate the regulating cam 90 having the cam acting portion 90*a* coming in contact with the shaft 85 of the cam receiving member 83 to a position in which the cam non-acting portion 90*b* is opposed to the shaft 85 of the cam receiving member 83.

The movable protruded plate 94 is attached in a state in which a bottom portion 94*b* is fixed to the connecting shaft 86 in the changing mechanism 46, and a tip portion thereof is formed to take a shape of a plate which is protruded in almost a diametrical direction of the connecting shaft 86. Moreover, the movable protruded plate 94 is rotated interlockingly with the changing cam 84 through the connecting shaft 86 and comes in contact with the protruded plate 92 in a middle to rotate the regulating cam 90 in a process in which the changing cam 84 is rotated in the direction E2 of a transition from the third cam surface 84*c* to the first cam surface 84*a*. At this time, the movable protruded plate 94 is set in order to rotate the regulating cam 90 by an amount (an angle) in which the cam non-acting portion 90*b* of the regulating cam 90 is moved to the opposed position to the shaft 85 of the cam receiving member 83. The movable protruded plate 94 may be formed in an integral configuration with the changing cam 84.

Next, description will be given to an operation of the fixing device 4.

First of all, description will be given to an operation to be carried out in the case in which a paper other than an envelope-shaped object is used as the recording medium 9 to form an image (a normal mode).

Figure 17A:
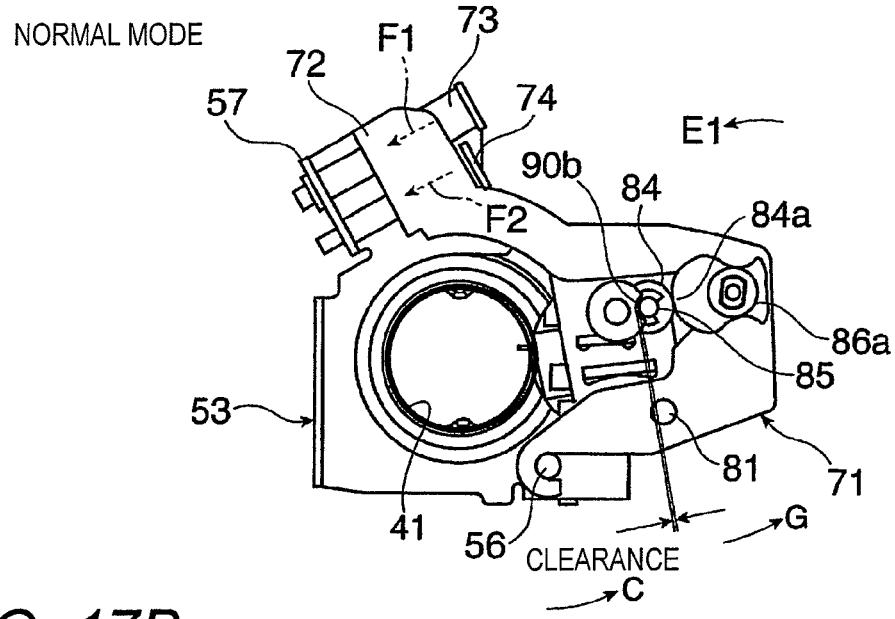
FIGS. 17A, 17B and 17C are explanatory views showing each state of the fixing device in a selection of the normal mode, FIG. 17A illustrating the state of the fixing device in the case in which the protruded plate, the movable protruded plate and the coil spring which form a part of the regulating mechanism are taken away, FIG. 17B illustrating the state of the fixing device in the case in which the part of the regulating mechanism is included, and FIG. 17C illustrating the state of the contact portion of the pressing member.
Figure 17B:
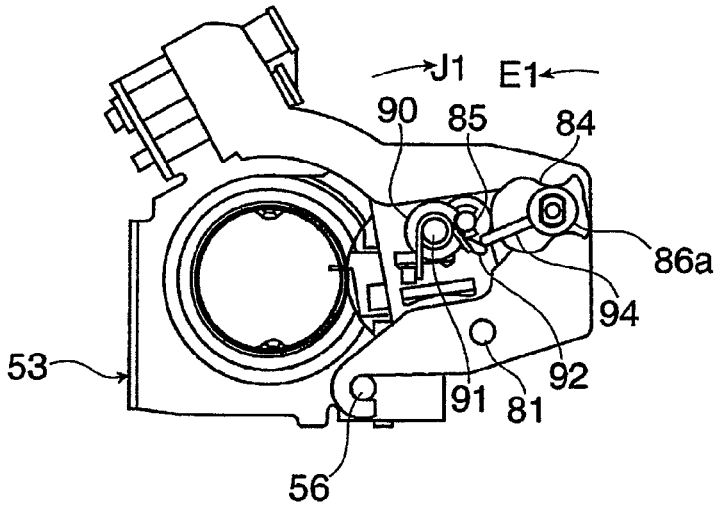

In the fixing device 4, when the normal mode is selected, the operating lever 88 of the switching mechanism 47 is operated to hold a state in which the changing cam 84 comes in contact with the cam receiving member 83 of the rock holding plate 80 through the first cam surface 84*a* as shown in FIGS. 4, 10 and 17.

In the pressurizing mechanism 45, consequently, the connecting shaft 86 of the changing cam 84 is moved to the most distant position from the cam receiving member 83. Therefore, the pressurization rocking frame 71 having the changing cam 84 attached thereto is rocked in the direction of the arrow D to separate from the heating roll 41 by setting the first shaft 56 as a fulcrum. At this time, the spring pressing surface portion 72 of the rocking frame 71 is moved in such a direction as to separate from the spring support surface portion 57 of the fixing frame 53 and is thus maintained at a predetermined distance (S1). In this case, moreover, a distance between the spring pressing surface portion 72 of the rocking frame 71 and the flange portion 75*a* of the strut 75 is set to be a distance for the normal mode. The distance for the normal mode is set to have a smaller value than both a free length L1 of the first compression coil spring 73 and a free length L2 of the second compression coil spring 74. Accordingly, both of the two compression coil springs 73 and 74 are held in a compressing state.

In the normal mode, the first compression coil spring 73 and the second compression coil spring 74 apply spring forces F1*a* and F2*a* (=a compression amount multiplied by a spring constant) corresponding to compression amounts and spring constants thereof so that the spring pressing surface portion 72 is continuously pressed in such a direction as to approach the spring support surface portion 57 of the fixing frame 53 by the spring forces F1*a* and F2*a*. For this reason, the pressurization rocking frame 71 is held in a rocking state toward a side to approach the heating roll 41 (the arrow C). In this case, "the principle of a lever" setting the first shaft 56, the spring pressing surface portion 72 and the changing cam 84 to be a fulcrum, a power point and an action point respectively works over the pressurization rocking frame 71. Consequently, the spring forces F1*a* and F2*a* transmit strong forces intensified by the principle of a lever from the pressurization rocking frame 71 to the changing cam 84 to be the action point.

As a result, the pressurization rocking frame 71 presses the rock holding plate 80 through the changing cam 84 and the cam receiving member 83 in such a direction as to approach the heating roll 41. Therefore, the pressing member 43 supported on the rock holding plate 80 through the support plate 65 of the pressing support member 63 is pressed toward the heating roll 41 at a high pressure X which is required in a fixation in the normal mode. In this case, a reactive force to be a reaction to the pressure X is generated in the heating roll 41 attached and fixed to the fixing frame 53. Consequently, the reactive force is balanced with a load (a pressing force) of the pressurizing mechanism 45 so that the pressurization rocking frame 71 is brought into a stationary state.

In the normal mode, moreover, the pressurization rocking frame 71 is maintained in a state in which the rock holding plate 80 is rocked in the direction C to approach the heating roll 41 through the changing cam 84 serving as a part of the changing mechanism 46. Consequently, the rock holding plate 80 serving as a part of the changing mechanism 46 is maintained in such a state as to be rocked in the direction of the arrow G by setting the shaft 81 as a fulcrum. Therefore, the pressing member 43 is maintained in such a state as to be moved to an upstream side in the direction B of the passage of the fixing target in the pressure contact portion NP, and both (the protruded portion 61*a* of) the head member 61 and the pad member 62 which are contact portions of the pressing member 43 are finally maintained in a state in which the fixing belt 42 is pressed against the heating roll 41 (see FIGS. 10 and 17C).

A position in which both the head member 61 and the pad member 62 in the pressing member 43 come in contact with the heating roll 41 and are thus stopped at this time is equivalent to the normal set position. In this case, moreover, the regulating mechanism 48 is set to bring a state in which the movable protruded plate 94 comes in contact with the protruded plate 92 of the regulating cam 90 to continuously press the protruded plate 92 and a state in which the regulating cam 90 causes the cam non-acting portion 90*b* to be opposed to the shaft 85 of the cam receiving member 83 as shown in FIG. 10. At this time, furthermore, the protruded plate 92 is set to be rotated in such a direction as to contract the coil spring 93 to be the helical spring, resulting in a storage of a predetermined spring force in the coil spring 93.

As described above, in the normal mode, there is brought a state in which the high pressure X for the fixation is applied to the pressure contact portion NP of the fixing device 4 through the pressing member 43, and furthermore, the pressure contact portion NP is formed through the press of both (the protruded portion 61*a* of) the head member 61 and the pad member 62 in the pressing member 43. Referring to a pressure (distribution) applied to the pressure contact portion NP of the heating roll 41 in a selection of the normal mode, moreover, a pressure applied by the head member 61 disposed on the downstream side in the direction B of the passage of the fixing target in the pressure contact portion NP is higher than a pressure applied by the pad member 62 disposed on the upstream side in the direction B of the passage.

In the selection of the normal mode, when the sheet-shaped recording medium 9 holding an unfixed toner image to be the fixing target is introduced into the pressure contact portion NP of the fixing device 4, the pad member 62 to be an elastic member which is disposed on the upstream side in the direction B of the passage of the fixing target in the pressure contact portion NP first presses the recording medium 9 against the rotated heating roll 41 (through the fixing belt 42). Subsequently, (the protruded portion 61*a* of) the head member 61 to be a non-elastic member which is disposed on the downstream side in the direction B of the passage of the fixing target in the pressure contact portion NP presses the recording medium 9 against the heating roll 41 (through the fixing belt 42). In the normal mode, thus, there is carried out a fixation processing in which the sheet-shaped recording medium 9 is caused to pass the pressure contact portion NP indicative of different pressure distributions in the direction B of the passage thereof.

Next, description will be given to an operation to be executed in the case in which an image is formed by using, as the recording medium 9, an envelope-shaped object represented by an envelope (an envelope mode).

Figure 13A:
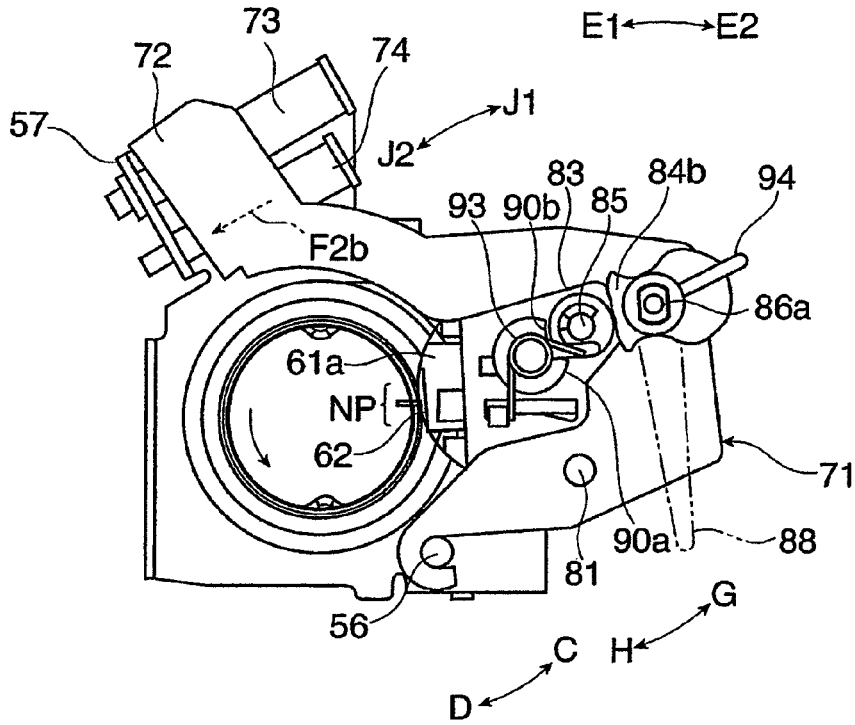
FIGS. 13A and 13B are explanatory views showing a main part, FIG. 13A illustrating a state of the fixing device in a selection of an envelope mode and FIG. 13B illustrating the state of the fixing device in a selection of a jam eliminating mode.
Figure 14A:
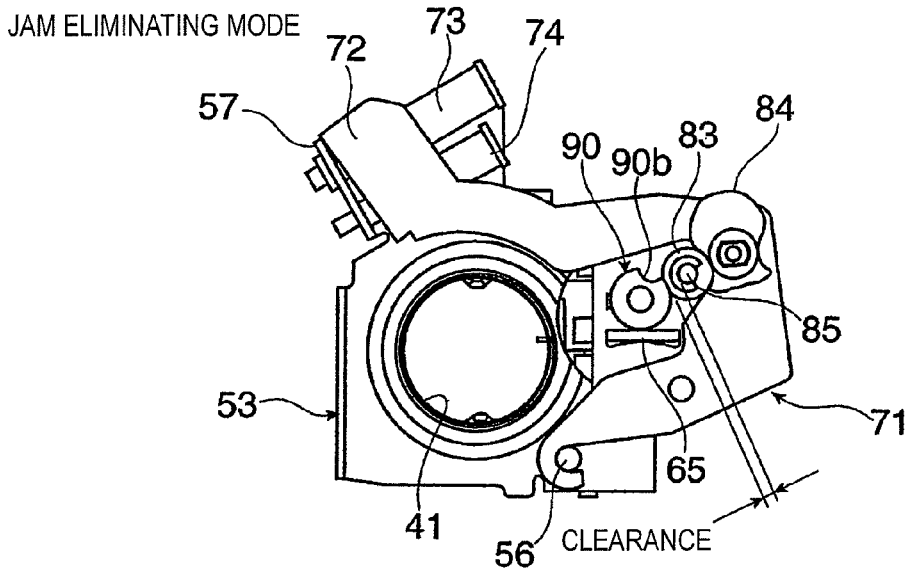
FIGS. 14A, 14B and 14C are explanatory views showing each state of the fixing device in the selection of the jam eliminating mode, FIG. 14A illustrating the state of the fixing device in the case in which the protruded plate, the movable protruded plate and the coil spring which form a part of the regulating mechanism are taken away, FIG. 14B illustrating the state of the fixing device in the case in which the part of the regulating mechanism is included, and FIG. 14C illustrating a state of the contact portion of the pressing member.

In the fixing device 4, when the envelope mode is selected, the operating lever 88 of the switching mechanism 47 is operated so that the changing cam 84 is held in a state in which it comes in contact with the cam receiving member 83 of the rock holding plate 80 through the second cam surface 84*b* as shown in FIG. 13A.

In the pressurizing mechanism 45, consequently, the connecting shaft 86 of the changing cam 84 is moved to a closer position to the cam receiving member 83 than that in the selection of the fixing mode. At this time, therefore, the pressurization rocking frame 71 is rocked in the direction of the arrow C which approaches the heating roll 41. As a result, the spring pressing surface portion 72 of the pressurization rocking frame 71 is moved in such a direction as to approach the spring support surface portion 57 of the fixing frame 53 and is thus held in a separating position at a predetermined distance.

In this case, a distance between the pressing surface portion 72 and the flange portion 75*a* of each of the struts in the two compression coil springs 73 and 74 is equivalent to a distance for the envelope mode. A distance on the compression coil spring 73 side for the envelope mode is set to have a greater value than the free length L1 of the first compression coil spring 73, while a distance E2*b* on the compression coil spring 74 side is set to have a smaller value than the free length L2 of the second compression coil spring 74. Moreover, the first compression coil spring 73 is disposed in a more distant position from the first shaft 56 than the second compression coil spring 74. Therefore, the distance on the first compression coil spring 73 side is greater than the distance on the second compression coil spring 74 side. In the pressurizing mechanism 45, accordingly, the first compression coil spring 73 is set to have the free length (L1) and is not compressed at all, while the second compression coil spring 74 is expanded a little as compared with the first pressing state and is held in a slight compressing state.

In the envelope mode, only the second compression coil spring 74 in the pressurizing mechanism 45 applies a spring force F2*b* (=a compression amount multiplied by a spring constant) depending on the compression amount and the spring constant so that the spring pressing surface portion 72 is continuously pressed in such a direction as to approach the spring support surface portion 57 by the spring force F2*b*. For this reason, the pressurization rocking frame 71 is held in a state in which it is rocked toward such a side as to approach the heating roll 41 (the direction of the arrow C). In this case, "the principle of a lever" acts on the pressurization rocking frame 71 in the same manner as in the normal mode. However, only the spring force F2*b* generated by the second compression coil spring 74 is simply intensified in accordance with the principle of a lever so that a smaller force than the force in the normal mode is transmitted to the changing cam 84 serving as the action point. Moreover, the spring force F2*b* itself is also reduced because the second compression coil spring 74 is expanded more greatly than in the normal mode so that the compression amount is decreased.

As a result, the pressurization rocking frame 71 presses the rock holding plate 80 in such a direction as to approach the heating roll 41 in the same manner as in the normal mode. However, the force transmitted to the changing cam 84 is smaller than that in the normal mode. For this reason, the pressing member 43 supported on the rock holding plate 80 is pressed against the heating roll 41 at a lower pressure Y (<X) than the high pressure X required in the normal fixation. The pressure (distribution) applied to the pressure contact portion NP of the heating roll 41 in the envelope mode includes only a low pressure applied by the pad member 62. The pressure is lower than the pressure X applied in the normal mode. Since the pad member 62 is the elastic member, moreover, an elastic deformation is apt to be caused toward the pad member 62 side in the pressure contact portion NP.

Also in the envelope mode, furthermore, the pressurization rocking frame 71 serving as the pressurizing mechanism 45 maintains the rock holding plate 80 in a state in which it is rocked in such a direction as to approach the heating roll 41 through the changing cam 84 in the same manner as in the selection of the normal mode.

In this case, however, a force for pressing the rock holding plate 80 by the pressurization rocking frame 71 is smaller than that in the normal mode and a force for pressing the heating roll 41 by the pressing member 43 is also small. For this reason, the pressing member 43 receives a force generated by a frictional force of the heating roll 41 which carries out a rotation in the direction shown in the arrow and the fixing belt 42 which is driven and rotated. Consequently, the rock holding plate 80 is maintained to be rocked in the direction of the arrow H by setting the shaft 81 as a fulcrum. As a result, the pressing member 43 is held to be displaced to a position shifted toward the downstream side in the direction B of the passage of the fixing target in the pressure contact portion NP. Therefore, (the protruded portion 61*a* of) the head member 61 in the pressing member 43 is moved in such a direction as to separate from the heating roll 41 to bring a state in which the heating roll 41 is not pressed. On the other hand, only the pad member 62 is moved to an opposed position to the heating roll 41 to bring a state in which the fixing belt 42 is pressed against the heating roll 41 (changed).

At this time, a position in which the pad member 62 to be the contact portion of the pressing member 43 comes in contact with the heating roll 41 and is thus brought into a stopping state is equivalent to the first set position in changing. In this case, moreover, the regulating mechanism 48 is brought into a state in which the movable protruded plate 94 is caused to separate from the protruded plate 92 of the regulating cam 90, and the shaft 85 of the cam receiving member 83 is displaced in such a direction as to separate from the regulating cam 90 through a rocking motion of the rock holding plate 80 as shown in FIG. 13A. Consequently, the regulating cam 90 is set to be rotated in a direction of an arrow J1 upon receipt of a spring force of the coil spring 93 to bring a state in which the cam non-acting portion 90*b* is opposed to the shaft 85 of the cam receiving member 83 so that the cam acting portion 90*a* is prevented from coming in contact with the shaft 85.

From the foregoing, in the envelope mode, the low pressure Y for the envelope mode is applied to the pressure contact portion NP of the fixing device 4 through the pressing member 43, and furthermore, the pressure contact portion NP is formed by the press of only the pad member 62 constituted by the elastic member in the pressing member 43.

In the selection of the envelope mode, when the envelope-shaped recording medium 9 holding an unfixed toner image to be a fixing target is introduced into the pressure contact portion NP, only the pad member 62 having an elasticity to which the low pressure Y is applied presses the recording medium 9 against the heating roll 41 (through the fixing belt 42). In the envelope mode, thus, the fixation processing for the envelope-shaped recording medium 9 is carried out in an environment in which a lower pressurization than that in the normal mode is performed and the pressure contact portion NP is elastically deformed corresponding to a situation of the passage of the recording medium 9, and furthermore, the pressurization rocking frame 71 is also rocked by a necessary amount for the fixing frame 53 corresponding to the situation of the passage, resulting in a wholly mutual (dynamic) balancing state. In the envelope mode, moreover, the compression coil springs 73 and 74 of the pressurizing mechanism 45 are prevented from being compressed more forcedly than in the normal mode. As a result, in the envelope mode, a wrinkle is prevented from being generated in (particularly, an end region to be the upstream side in the direction B of the passage in) the envelope-shaped recording medium 9. Consequently, an excellent fixation can be carried out.

Next, description will be given to an operation to be executed in the case in which a work for taking the recording medium 9 getting jammed away from the fixing device 4 is carried out in an occurrence of a jam phenomenon in which the recording medium 9 is interposed and gets jammed in the pressure contact portion NP of the fixing device 4 (a jam eliminating mode).

Figure 13B:
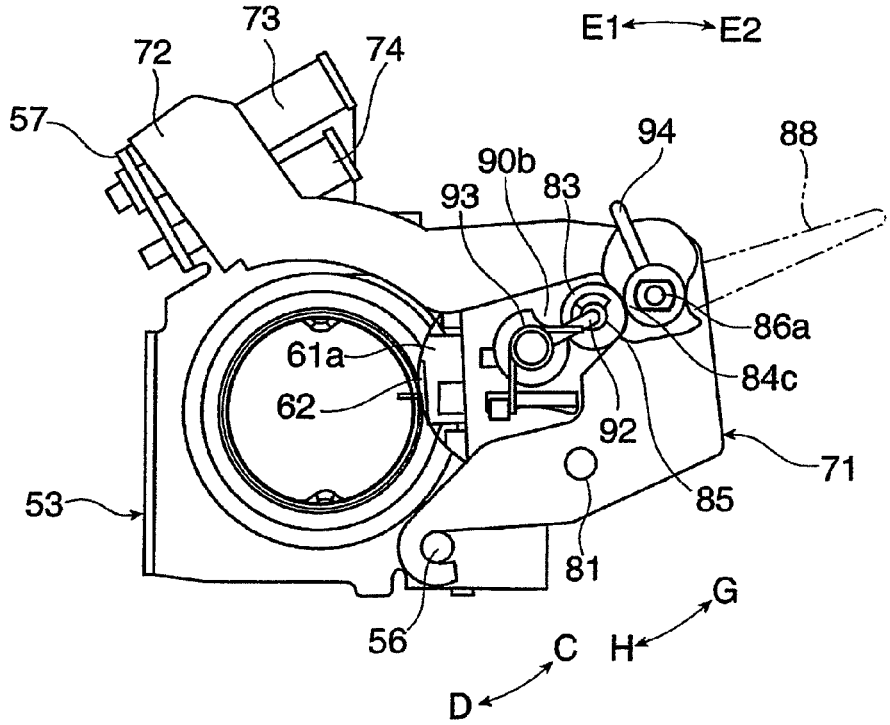
Figure 14B:
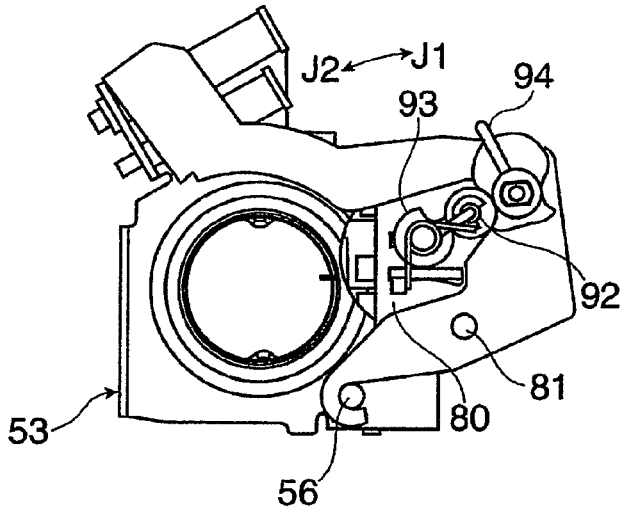
Figure 14C:
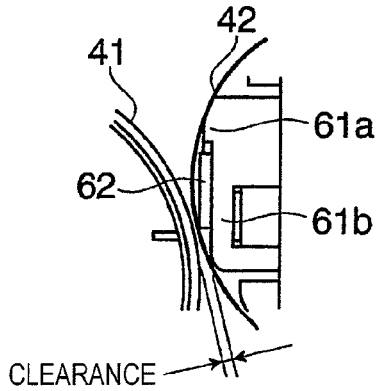

In the fixing device 4, when the jam eliminating mode is selected, the operating lever 88 of the switching mechanism 47 is operated so that the changing cam 84 is held in a state in which it comes in contact with the cam receiving member 83 of the rock holding plate 80 through the third cam surface 84*c* as shown in FIGS. 13B and 14.

In the pressurizing mechanism 45, consequently, there is brought a state in which the connecting shaft 86 of the changing cam 84 is moved to a closer position to the cam receiving member 83 than that in the selection of the envelope mode. At this time, therefore, the pressurization rocking frame 71 is further rocked in the direction of the arrow C to approach the heating roll 41. As a result, the spring pressing surface portion 72 of the pressurization rocking frame 71 is brought into a colliding state with the spring support surface portion 57 of the fixing frame 53.

At this time, a distance between the spring pressing surface portion 72 of the pressurization rocking frame 71 and the flange portion 75*a* of the strut 75 is equivalent to a distance for the jam eliminating mode. A distance on the compression coil spring 73 side for the jam eliminating mode is set to have a greater value than the free length L1 of the first compression coil spring 73, while a distance on the second compression coil spring 74 side for the jam eliminating mode is set to have a smaller value than the free length L2 of the second compression coil spring 74 (a greater value than the distance E2*b* in the envelope mode). For this reason, in the pressurizing mechanism 45, the first compression coil spring 73 is set to have the free length and is not compressed at all, and the second compression coil spring 74 is expanded slightly as compared with the envelope mode and is compressed faintly in almost the same manner as in the envelope mode. In addition, the pressurization rocking frame 71 is brought into a state in which the spring pressing surface portion 72 collides with the spring support surface 57 of the fixing frame 53 so that the pressurization rocking frame 71 is not rocked any longer toward a side to approach the heating roll 41 (the direction of the arrow C).

As a result, only the second compression coil spring 74 in the pressurizing mechanism 45 applies a spring force F2*c* depending on a compression amount and a spring constant thereof to continuously press the spring pressing surface portion 72 in such a direction as to approach the spring support surface portion 57 of the fixing frame 53. In this case, however, the spring pressing surface portion 72 is maintained in a colliding state with the spring support surface portion 57. Therefore, the pressurization rocking frames 71 and 72 are inhibited from being further rocked toward the side to approach the heating roll 41 (in the direction of the arrow C) from a colliding position even if it receives the spring force F2*c* of the second compression coil spring 74.

On the other hand, in the jam eliminating mode, when the pressurization rocking frame 71 is inhibited from being rocked toward the side to approach the heating roll 41, the changing cam 84 is brought into a state in which a force for rocking the rock holding plate 80 in such a direction as to approach the heating roll 41 is not applied. Moreover, a distance between the third cam surface 84*c* and the connecting shaft 86 is set to have a smaller value than that in the envelope mode. Therefore, the rock holding plate 80 is further rocked in the direction of the arrow H than in the envelope mode. For this reason, the head member 61 and the pad member 62 in the pressing member 43 are displaced toward the downstream side in the direction B of the passage of the fixing target and are finally brought into a state in which a clearance is generated slightly apart from the surface of the heating roll 41 (see FIG. 14C).

A position in which the head member 61 and the pad member 62 that are the contact portions of the pressing member 43 at this time are caused to separate from the heating roll 41 and are thus brought into a stopping state is equivalent to the second set position in changing. In this case, moreover, the regulating mechanism 48 is brought into a state in which the movable protruded plate 94 is caused to separate from the protruded plate 92 of the regulating cam 90 and the shaft 85 of the cam receiving member 83 is further displaced in such a direction as to separate from the regulating cam 90 through a further rocking motion of the rock holding plate 80 as shown in FIGS. 12B and 13B. Consequently, the regulating cam 90 is rotated in a direction of an arrow J2 upon receipt of the spring force of the coil spring 93 so that the cam non-acting portion 90*b* is moved to a non-opposed position to the shaft 85 of the cam receiving member 83 and the regulating cam 90 is set into a state in which it is perfectly caused to separate from the shaft 85 of the cam receiving member 83 with a clearance (see FIG. 14A).

From the foregoing, in the jam eliminating mode, there is brought a state in which the pressure applied from a pressing mechanism 7 to the pressing member 62 does not exceed a certain value and the pressing member 62 can be displaced to generate a clearance from the heating roll 41.

In the jam eliminating mode, even if the recording medium 9 to be the fixing target is interposed and gets jammed in the pressure contact portion NP, the rock holding plate 80 is rocked a little in the direction of the arrow H so that the pressing member 43 is slightly caused to separate from the heating roll 41 when a user holds a part of the recording medium 9 by a hand and pulls the same part toward a recording medium discharging side. Consequently, the recording medium 9 getting jammed is easily pulled out of the pressure contact portion NP and is thus taken away.

Moreover, the fixing device 4 is operated in the following manner when switching from the jam eliminating mode to the normal mode is carried out.

Figure 15A:
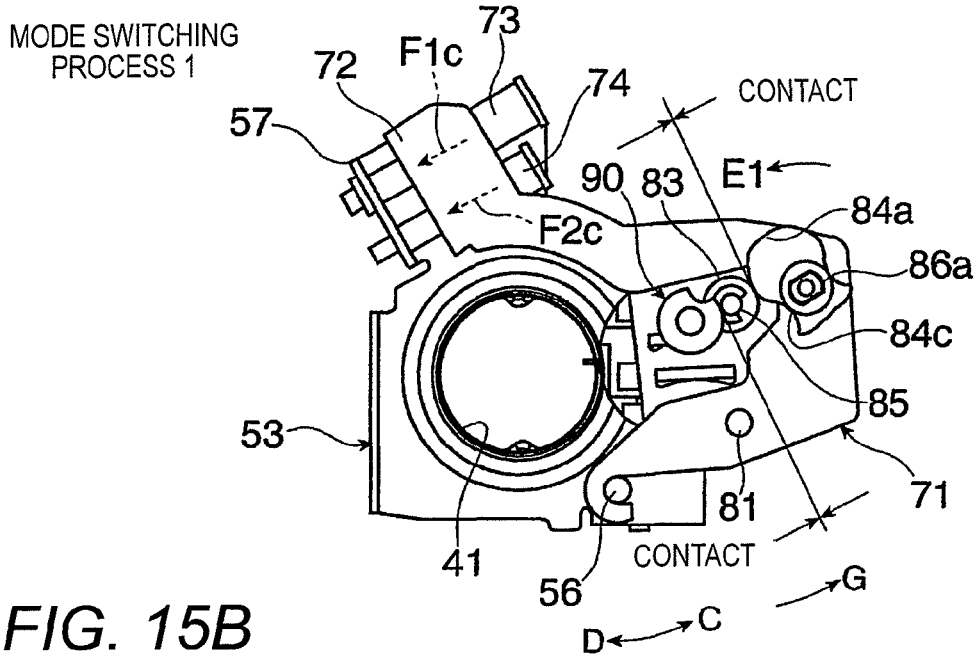
FIGS. 15A, 15B and 15C are explanatory views showing each state of the fixing device in a process 1 in switching from the jam eliminating mode to a normal mode, FIG. 15A illustrating the state of the fixing device in the case in which the protruded plate, the movable protruded plate and the coil spring which form a part of the regulating mechanism are taken away, FIG. 15B illustrating the state of the fixing device in the case in which the part of the regulating mechanism is included, and FIG. 15C illustrating the state of the contact portion of the pressing member.
Figure 15B:
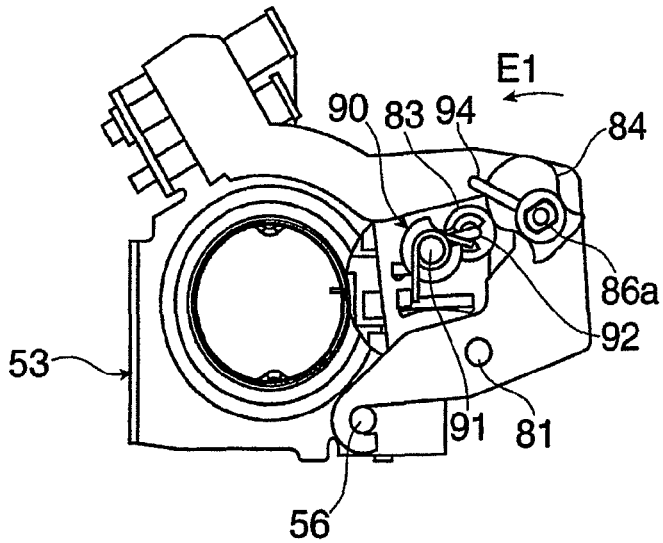
Figure 15C:
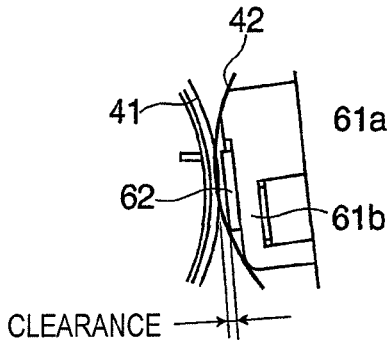

First of all, the operating lever 88 of the switching mechanism 47 is operated to rotate the changing cam 84 set in the jam eliminating mode in the direction of the arrow E1, thereby starting a transition for a surface of the changing cam 84 which comes in contact with the cam receiving member 83 from the third cam surface 84*c* toward the first cam surface 84*a* as shown in a "mode switching process 1" of FIG. 15.

By the rotation of the changing cam 84, the connecting shaft 86 is started to separate from the cam receiving member 83. Therefore, the pressurization rocking frame 71 is started to be rocked in the direction of the arrow D around the first shaft 56. On the other hand, the spring pressing surface portion 72 is brought into a separating state from the spring support surface portion 57 of the fixing frame 53 by the rocking motion of the pressurization rocking frame 71. Consequently, the compression coil springs 73 and 74 are started to be brought into a compressing state, and furthermore, spring forces F1*c* and F2*c* corresponding to compression amounts are started to be generated. By the spring forces F1*c* and F2*c*, the pressurization rocking frame 71 is also held in a rocking state in the direction of the arrow C around the first shaft 56. Therefore, a force for rocking the pressurization rocking frame 71 in the direction of the arrow C at this time is transmitted to the rock holding plate 80 through the changing cam 84 and the cam receiving member 83.

As a result, the rock holding plate 80 is set into a state in which it can be rocked in the direction of the arrow G around the second shaft 81. Therefore, the pad member 62 to be the contact portion of the pressing member 43 is started to be slightly displaced from the second set position in changing toward the upstream side in the direction B of the passage of the fixing target. Consequently, the pad member 62 is started to be brought into a state in which it approaches the heating roll 41 through the fixing belt 42 (for example, is present in the first set position in changing). When the rock holding plate 80 is rocked by a predetermined amount in the direction of the arrow G, however, the shaft 85 of the cam receiving member 83 comes in contact with (the cam acting portion 90*a* of) the regulating cam 90 of the regulating mechanism 48 as shown in FIG. 15A.

After the shaft 85 of the cam receiving member 83 comes in contact with the regulating cam 90, accordingly, it is inhibited from being further displaced by the regulating cam 90 attached to the fixing shaft 91 and having a position fixed even if the rock holding plate 80 tries to be rocked in the direction of the arrow G upon receipt of a pressure from the pressurization rocking frame 71. For this reason, as shown in an enlarged view of FIG. 15C, the pad member 62 of the pressing member 43 is held in a non-contact state with a clearance from the heating roll 41. In this stage, the movable protruded plate 94 is simply brought into a state in which it approaches the protruded plate 92 of the regulating cam 90 and does not come in contact therewith.

Figure 16A:
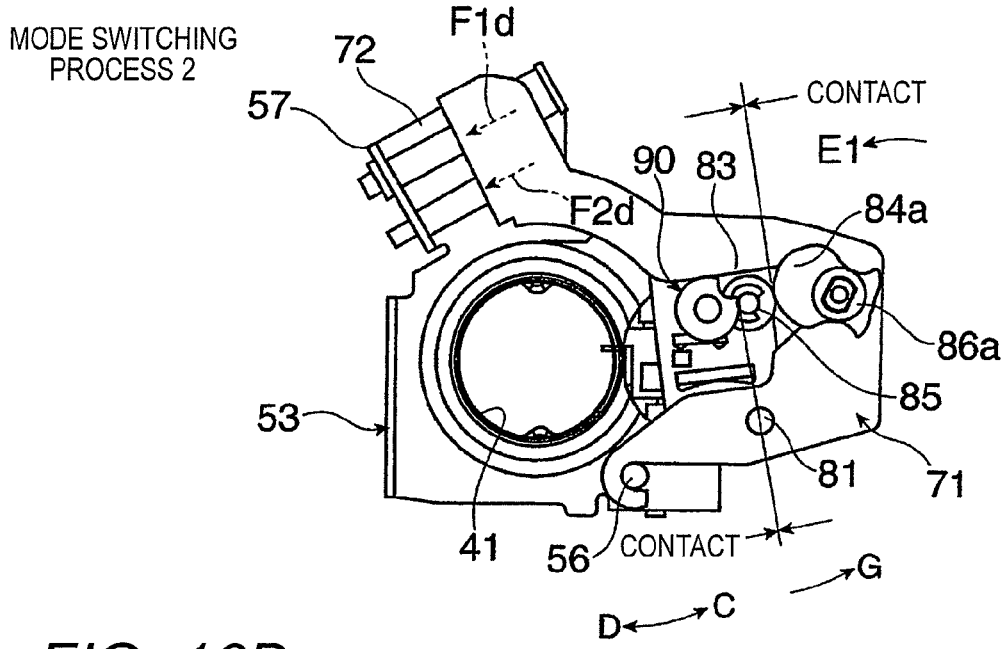
FIGS. 16A, 16B and 16C are explanatory views showing each state of the fixing device in a process 2 (a subsequent process to the process 1) in the switching from the jam eliminating mode to the normal mode, FIG. 16A illustrating the protruded plate which forms a part of the regulating mechanism and the state of the fixing device in the case in which the movable protruded plate and the coil spring are taken away, FIG. 16B illustrating the state of the fixing device in the case in which the part of the regulating mechanism is included, and FIG. 16C illustrating the state of the contact portion of the pressing member.
Figure 16B:
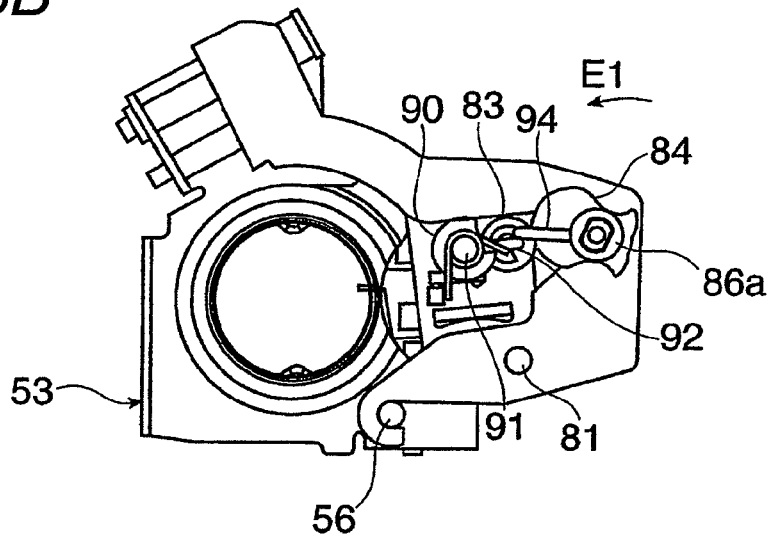
Figure 16C:
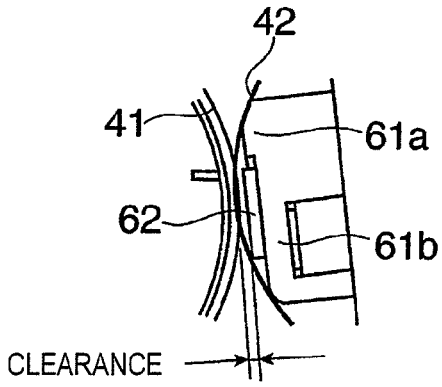

Subsequently, the operating lever 88 is operated. Thus, the changing cam 84 is further rotated in the direction of the arrow E1 to make a transition until the first cam surface 84*a* of the changing cam 84 is caused to come in contact with the cam receiving member 83 as shown in a "mode switching process 2" of FIG. 16.

By a further rotation of the changing cam 84, the connecting shaft 86 is started to separate from the cam receiving member 83 more greatly. Therefore, the pressurization rocking frame 71 is brought into a further rocking state in the direction of the arrow D around the first shaft 56. By the further rocking motion of the pressurization rocking frame 71, the spring pressing surface portion 72 is brought into a further separating state from the spring support surface portion 57 of the fixing frame 53. Consequently, the compression coil springs 73 and 74 are started to be brought into a further compressing state, and furthermore, spring forces F1*d* and F2*d* corresponding to increased compression amounts are generated. By the spring forces F1*d* and F2*d* thus intensified, the pressurization rocking frame 71 is also maintained in a further rocking state in the direction of the arrow C around the first shaft 56, and a force for rocking the pressurization rocking frame 71 in the direction of the arrow C at this time is also transmitted to the rock holding plate 80 through the changing cam 84 and the cam receiving member 83.

Also in the process 2, however, the shaft 85 of the cam receiving member 83 is set into a contact state with the regulating cam 90 of the regulating mechanism 48. Even if the rock holding plate 80 tries to be rocked in the direction of the arrow G upon receipt of a pressure from the pressurization rocking frame 71, therefore, the shaft 85 is continuously inhibited from being further displaced through the regulating cam 90. As shown in an enlarged view of FIG. 16C, moreover, the pad member 62 of the pressing member 43 is also held in a non-contact state with a clearance from the heating roll 41 in the same manner as in the case of the process 1. In a stage of the process 2, since the movable protruded plate 94 is rotated interlockingly with the further rotation of the changing cam 84 through the connecting shaft 86, it approaches the protruded plate 92 of the regulating cam 90 and thus comes in contact therewith.

Finally, the movable protruded plate 94 comes in contact with the protruded plate 92 of the regulating cam 90 and the operating lever 88 is then operated to further rotate the changing cam 84 in the direction of the arrow E1, thereby making a transition to a state in which the first cam surface 84*a* of the changing cam 84 is caused to come in contact with the cam receiving member 83.

As shown in FIG. 17, consequently, the movable protruded plate 94 rotated in the direction of the arrow E1 displaces the protruded plate 92 to be rotated in the direction of the arrow J1, and the regulating cam 90 is rotated in the direction of the arrow J1 interlockingly with the rotation of the protruded plate 92. As a result, in the regulating cam 90 having the cam acting portion 90*a* coming in contact with the shaft 85 of the cam receiving member 83, the cam non-acting portion 90*b* is brought into an opposing state to the shaft 85 of the cam receiving member 83. In this case, the cam non-acting portion 90*b* is maintained in a non-contact state with a slight clearance from the shaft 85. At this time, the coil spring 93 is contracted through the rotation of the regulating cam 90 in the direction of the arrow J1 and is thus brought into a state in which a spring force is stored.

In a stage in which the cam acting portion 90*a* of the regulating cam 90 is opened from the contact with the shaft 85 of the cam receiving member 83 and the cam non-acting portion 90*b* is brought into the opposing state to the shaft 85, the shaft 85 is released from a displacement inhibiting condition through the regulating cam 90 and is brought into a displaceable state. As a result, the pressurization rocking frame 71 is rocked in the direction of the arrow C upon receipt of the spring forces F1 and F2 of the compression coil springs 73 and 74 set into two compressing states, and furthermore, the rock holding plate 80 is also rocked in the direction of the arrow G by the rocking motion.

Figure 17C:
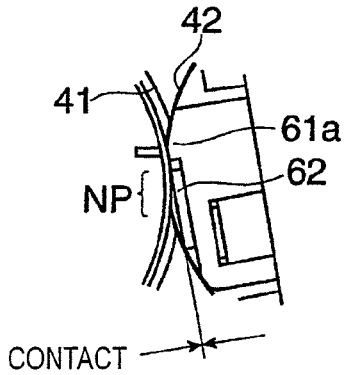

In the pressing member 43 held in the rock holding plate 80 at this time, accordingly, the head member 61 and the pad member 62 which are the contact portions are displaced toward an upstream side in the direction B of the passage of the fixing target and are finally returned to a position in which they come in contact with the heating roll 41 through the fixing belt 42 (the normal set position) as shown in an enlarged view of FIG. 17C. In addition, a predetermined pressure required for selecting the normal mode by the pressurizing mechanism 45 is applied to the pressing member 43 through the pressurization rocking frame 71.

Thus, the pad member 62 of the pressing member 43 is prevented from being displaced toward the upstream side in the direction B of the passage of the fixing target in the pressure contact portion NP in a state in which the pressure is applied from the pressurizing mechanism 45 so that the pad member 62 comes in contact with the heating roll 41 through the fixing belt 42 in a stage in which switching from the jam eliminating mode to the normal mode is carried out. In other words, the pad member 62 is displaced until the normal set position is reached in a separating state from the heating roll 41, and is brought into a contact state with the heating roll 41 through the fixing belt 42 when the normal set position is reached.

Figure 18A:
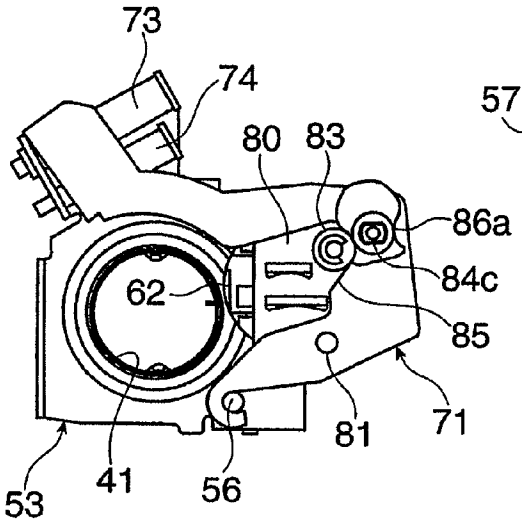
FIGS. 18A, 18B and 18C are explanatory views showing each state in the case in which there is carried out the switching from the jam eliminating mode to the normal mode in the fixing device constituted without the regulating mechanism, FIG. 18A illustrating the state of the fixing device in the jam eliminating mode, FIG. 18B illustrating the state of the fixing device in a process for the mode switching from the jam eliminating mode to the normal mode, and FIG. 18C illustrating the state of the fixing device in the normal mode.
Figure 18B:
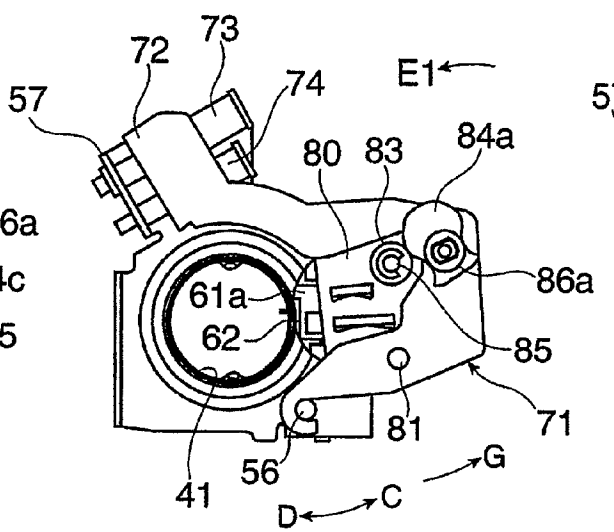
Figure 18C:
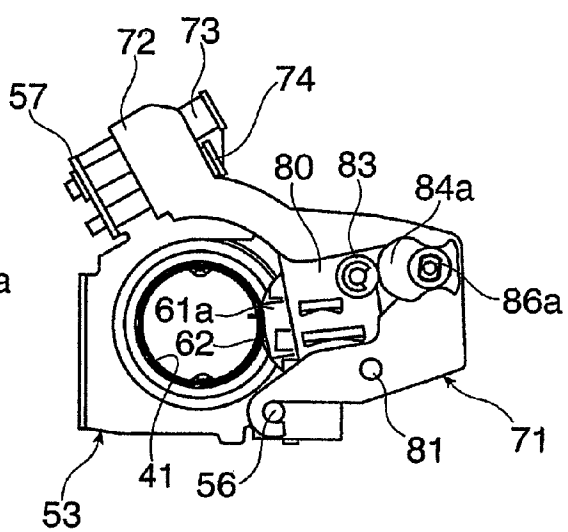

On the other hand, the following phenomenon occurs when the switching from the jam eliminating mode to the normal mode is carried out in the fixing device 4 having no regulating mechanism 48 as shown in FIG. 18, for example. It is assumed that the fixing device shown in FIG. 18 has the same structure as that of the fixing device 4 according to the first embodiment except that the regulating mechanism 48 is not provided.

More specifically, when the changing cam 84 is rotated in the direction of the arrow E1 so that a surface to come in contact with the cam receiving member 83 is started to make a transition from the third cam surface 84*c* toward the first cam surface 84*a*, the connecting shaft 86 is caused to separate from the cam receiving member 83 so that the pressurization rocking frame 71 is brought into a state in which it is rocked in the direction of the arrow D and is also rocked in the direction of the arrow C upon receipt of the spring forces of the two compression coil springs 73 and 74. Consequently, the rock holding plate 80 is rocked in the direction of the arrow G upon exact receipt of a pressure from the pressurization rocking frame 71. For this reason, the pad member 62 of the pressing member 43 held in the rock holding plate 80 is also displaced from the second set position in changing toward the normal set position which is set to an upstream side in the direction B of the passage of the fixing target in the pressure contact portion NP, and furthermore, is brought into a contact state with the heating roll 41 through the fixing belt 42.

In this case, however, the pad member 62 of the pressing member 43 comes in contact with the heating roll 41 through the fixing belt 42 in a state in which a pressure is applied from the pressurizing mechanism 45, and is displaced toward the upstream side in the direction B of the passage of the fixing target in the pressure contact portion NP in a contact state under the pressure in a stage in which the switching from the jam eliminating mode to the normal mode is carried out.

Figure 19A:
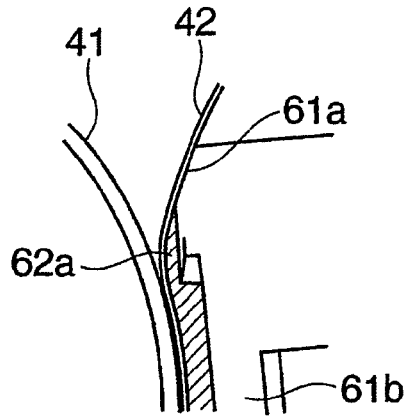
FIGS. 19A, 19B and 19C are explanatory views showing a phenomenon of a defect caused when the switching from the jam eliminating mode to the normal mode is carried out in the fixing device of FIG. 18, FIG. 19A illustrating a state in which a part of a pad member to be an elastic member is extended over, FIG. 19B illustrating a state of a pressure contact portion in which a deformed part of an extended portion of the pad member is present, and FIG. 19C illustrating a state in which a part of the extended portion of the pad member is lost.
Figure 19B:
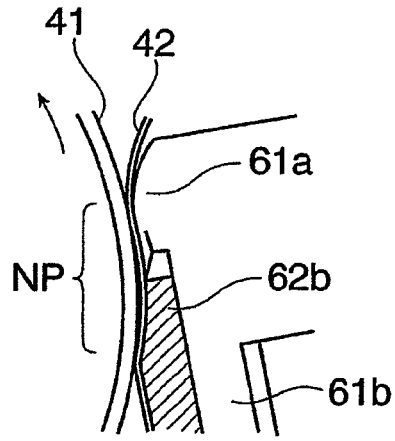
Figure 19C:
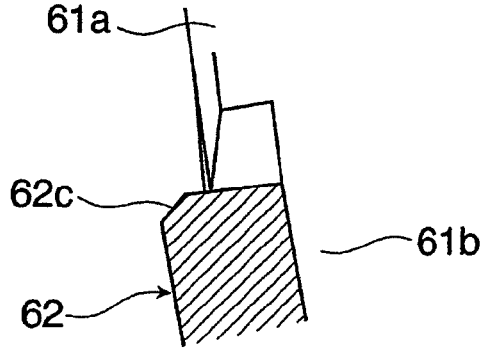

For this reason, in the selection of the jam eliminating mode, a part (a corner portion to be the downstream side in the direction B of the passage of the fixing target) 62*a* of the pad member 62 to be an elastic member which is protruded from the protruded portion 61*a* of the head member 61 toward the heating roll 41 side is brought into a deforming state to be extended over the protruded portion 61*a* of the head member 61 as shown in FIG. 19A. In the pad member 62 causing the extending phenomenon, moreover, an extended part is present as a deformed (degenerated) portion 62*b* as shown in FIG. 19B. The deformed portion 62*b* is present in the pressure contact portion NP in a subsequent fixation in the normal mode so that a pressure distribution of the pressure contact portion NP is changed, causing a different fixing result in some cases. In the pad member 62 causing the extending phenomenon, furthermore, a part of the extended portion 62*a* is broken to form a defective portion 62*c* as shown in FIG. 19C in some cases. By the presence of the defective portion 62*c*, the pressure distribution of the pressure contact portion NP is changed as described above and a fixing result at that time is also varied in some cases.

In this respect, in fixing device 4 and the image forming apparatus 1 using the fixing device 4 according to the first embodiment, a part of the pad member 62 in the pressing member 43 is prevented from being extended over the head member 61 by the function of the regulating mechanism 48 even if the switching from the jam eliminating mode to the normal mode is carried out. As a result, the pad member 62 in the pressing member 43 is prevented from being deformed or damaged. Consequently, it is possible to prevent a fixing failure from being caused by the deformation or damage.

In the fixing device 4, furthermore, also in the case in which the switching from the envelope mode to the normal mode is carried out, a part of the pad member 62 in the pressing member 43 can be prevented from being extended over the head member 61 by the function of the regulating mechanism 48. In the case in which the switching from the normal mode to the jam eliminating mode is carried out, the regulating cam 90 is rotated in the direction of the arrow J2 by the spring force stored in the coil spring 93 so that the cam non-acting portion 90*b* is moved to a position in which it is not opposed to the shaft 85 of the cam receiving member 83 when the rock holding plate 80 is rocked in the direction of the arrow H and the shaft 85 of the cam receiving member 83 thus gets out of the cam non-acting portion 90*b* of the regulating cam 90 and is caused to separate therefrom in a process in which the changing cam 84 is rotated so that the third cam surface 84*c* comes in contact with the cam receiving member 83.

Although there is illustrated the case in which (the cam radius of the cam acting portion 90*a* of) the regulating cam 90 is set to maintain the regulating mechanism 48 in a state in which the contact portion of the pressing member 43 does not come in contact with the heating roll 41 in the process in which the switching from the second state in changing (the jam eliminating mode) to the normal state (the normal mode) is carried out in the first embodiment, it is also possible to set the regulating cam 90 in order to maintain a state in which the contact portion of the pressing member 43 comes in contact with the heating roll 41 in a pressure reducing condition so as to be lower than the pressure required in the normal mode in the same process. In this case, it is sufficient that a rate of the pressure reduction is set to prevent a part of the pad member 62 in the pressing member 43 from being extended over the head member 61 when the switching from the jam eliminating mode to the normal mode is carried out. Although the normal set position is indicated as the "first position" and the second set position in changing is indicated as the "second position" in the first embodiment, it is also possible to change the set contents of the first and second positions to have other structures within a range in which the functions and effects can be obtained.

Although there is illustrated the case in which (the shaft 85 of) the cam receiving member 83 provided on the rock holding plate 80 is employed for the target with which the regulating cam 90 to be the regulating mechanism 48 is caused to come in contact, moreover, a contact portion (including a shaft) other than the cam receiving member 83 formed in a part of the rock holding plate 80 can also be employed for the target to come in contact, for example.

Although there is illustrated the structure of the pressing member 43 in which two types of the head member 61 and the pad member 62 come in contact with the heating roll 41 through the fixing belt 42, furthermore, the invention is not restricted to the structure but it is also possible to apply a pressing member constituted by only one of the head member 61 and the pad member 62, for example.

In addition, it is also possible to apply one or three compression coil springs or more as the pressurizing mechanism 45. It is also possible to constitute the pressurizing mechanism 45 by applying a spring such as a plate-shaped compression spring in place of the compression coil spring.

Moreover, it is also possible to constitute the fixing device 4 by applying a fixing roll having no heating means in place of the heating roll 41 and applying a press heating member having heating means as the pressing member 43. In the case in which heating means of an electromagnetic induction type is applied as the heating means of the press heating member, for example, it is preferable to use a non-end belt having a conductive layer as the fixing belt 42.

In addition, for the imaging device 2 in the image forming apparatus 1, it is also possible to apply an imaging device of such a type as to form toner images having a plurality of colors and to transfer them onto the recording medium 9 respectively, thereby forming a multicolor image. For a transfer method in the imaging device 2, it is also possible to employ a well-known intermediate transfer method in place of a direct transfer method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing roll that is rotated;

a non-end fixing belt that is rotated in contact with the fixing roll;

a pressing member that contacts with a back side of the fixing belt and that forms a fixing portion by pressing the fixing belt against the fixing roll from the back side of the fixing belt, a fixing target passing through the fixing portion;

a pressurizing mechanism that makes the pressing member to press against the fixing roll through the fixing belt;

a changing mechanism that displaces a contact portion of the pressing member against the fixing roll so that the contact portion is displaced from a first area including a first position to a second area including a second position, the second position being on a downstream side in a passage direction of the fixing target in the fixing portion, and the changing mechanism that decreases or releases a predetermined pressure at the contact portion when the contact portion is at the second area, wherein the pressure applied at the first area is the predetermined pressure;

a switching mechanism that switches into either a state in which the contact portion of the pressing member is placed in the first area or a state in which the contact portion is placed in the second area through the changing mechanism; and a regulating mechanism, as the switching mechanism switches from the state in which the contact portion is placed in the second area to the state in which the contact portion is placed in the first area, (i) that regulates the contact portion of the pressing member through the fixing belt in a state in which the fixing belt is detached from the fixing roll or a state in which the pressure is reduced so that the fixing belt is detach from or contacts with the fixing roll during the contact portion is moved from the second area to the first area, and (ii) that transitions into a state in which the pressing member presses against the fixing roll through the fixing belt at the predetermined pressure at the first area.

2. The fixing device according to claim 1, wherein the pressing member is held in a holding member, the pressurizing mechanism has a movable member which carries out a displacement to press the holding member of the pressing member in such a direction as to approach the fixing roll upon receipt of a spring force, the changing mechanism includes a cam receiving member which rockably attaches the holding member of the pressing member to a part of the movable member of the pressurizing mechanism through a shaft so that one of ends of the holding member is in an upstream side of the passage direction of the fixing target and which is provided so that the other end of the holding member is in the downstream side of the passage direction of the fixing target, and a changing cam including a small diameter portion and a large diameter portion which contacts with the cam receiving member and which are rotatably provided in a part of the movable member, the switching mechanism has a member which rotates the changing cam, and the regulating mechanism has a regulating member which maintains a state in which the changing cam comes in contact with a part of the holding member to be rocked upon receipt of a force of the cam so as to inhibit the holding member from being displaced during the changing cam is rotated in such a direction as to make a transition from the small diameter portion to the large diameter portion, and which releases a state in which the displacement of the holding member is inhibited when the contact portion reaches the first area.

3. The fixing device according to claim 2, wherein a part of the holding member is the cam receiving member.

4. The fixing device according to claim 2, wherein the regulating member includes a regulating cam which is provided rotatably in a state in which a position of the regulating cam is fixed and which has both a cam acting portion and a cam non-acting portion, and a protruded portion which is moved interlockingly with a rotation of the regulating cam, the changing mechanism has a protruded member which is moved interlockingly with the rotation of the changing cam and which comes in contact with the protruded portion of the regulating member, and the protruded member of the changing mechanism rotates the regulating cam by contacting with the protruded portion of the regulating member, the regulating cam having the cam acting portion contacting with a part of the holding member, so that the cam non-acting portion is opposed to a part of the holding member when the contact portion reaches the first area.

5. An image forming apparatus comprising;

an imaging device that forms an unfixed image and that transfers the unfixed image onto a recording medium; and a fixing device that fixes the unfixed image transferred by the imaging device to the recording medium, wherein the fixing device includes the fixing device according to claim 1.

* * * * *